US011428239B2

(12) United States Patent
Koga et al.

(10) Patent No.: US 11,428,239 B2
(45) Date of Patent: Aug. 30, 2022

(54) COMPRESSOR SUCTION PIPE, COMPRESSION UNIT, AND CHILLER

(71) Applicant: MITSUBISHI HEAVY INDUSTRIES THERMAL SYSTEMS, LTD., Tokyo (JP)

(72) Inventors: Jun Koga, Tokyo (JP); Ryosuke Suemitsu, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 486 days.

(21) Appl. No.: 16/485,692

(22) PCT Filed: Feb. 22, 2018

(86) PCT No.: PCT/JP2018/006365
§ 371 (c)(1),
(2) Date: Aug. 13, 2019

(87) PCT Pub. No.: WO2018/180052
PCT Pub. Date: Oct. 4, 2018

(65) Prior Publication Data

US 2019/0390687 A1 Dec. 26, 2019

(30) Foreign Application Priority Data

Mar. 27, 2017 (JP) ..... JP2017-061333

(51) Int. Cl.
*F04D 29/42* (2006.01)
*F04D 29/44* (2006.01)
(Continued)

(52) U.S. Cl.
CPC ..... *F04D 29/4213* (2013.01); *F04D 29/444* (2013.01); *F25B 1/053* (2013.01);
(Continued)

(58) Field of Classification Search
CPC .... F04D 29/444; F04D 29/4213; F25B 1/053; F25B 31/00; F25B 41/40
(Continued)

(56) References Cited

U.S. PATENT DOCUMENTS 6,290,266 B1 9/2001 Kawano
2003/0192339 A1* 10/2003 Macbain ..... F16L 43/001 138/37
2009/0205361 A1* 8/2009 James ..... F25B 1/06 62/510

FOREIGN PATENT DOCUMENTS

JP 52-92412 U 7/1977
JP 56-12729 B2 3/1981
(Continued)

OTHER PUBLICATIONS

Office Action dated Jun. 2, 2020 issued in counterpart Chinese Application No. 201880018110.7 with a machine translation.
(Continued)

*Primary Examiner* — Steve S Tanenbaum
(74) *Attorney, Agent, or Firm* — Birch, Stewart, Kolasch & Birch, LLP

(57) ABSTRACT

A compressor suction pipe includes a bent portion at least including a first pipe segment on the most upstream side with respect to flow of a fluid to be compressed, a second pipe segment connected to a suction side of a compressor and extending in a direction different from the extension direction of the first pipe segment, and a third pipe segment disposed between the first pipe segment and the second pipe segment and extending in a direction different from the extension directions of the first and second pipe segments, and at least one partition extending at least from an intermediate portion of the first pipe segment at least to an intermediate portion of the second pipe segment in the bent portion and dividing an interior of the bent portion. The
(Continued)

partition extends in a direction intersecting a virtual plane including an incircle that touches an axis of the first pipe segment on an upstream side of a downstream end of the first pipe segment and touches an axis of the second pipe segment.

13 Claims, 14 Drawing Sheets

(51) Int. Cl.
*F25B 1/053* (2006.01)
*F25B 31/00* (2006.01)
*F25B 41/40* (2021.01)
*F25B 41/39* (2021.01)

(52) U.S. Cl.
CPC ..... *F25B 31/00* (2013.01); *F25B 41/39* (2021.01); *F25B 41/40* (2021.01)

(58) Field of Classification Search
USPC ..... 62/498
See application file for complete search history.

(56) References Cited

FOREIGN PATENT DOCUMENTS

| | | | |
|---|---|---|---|
| JP | 5-64510 | U | 8/1993 |
| JP | 11-153106 | A | 6/1999 |
| JP | 2011-102668 | A | 5/2011 |

OTHER PUBLICATIONS

International Preliminary Report on Patentability and Written Opinion of the International Searching Authority, dated Oct. 10, 2019, for International Application No. PCT/JP2018/006365, with a Written Opinion translation.
International Search Report, dated May 15, 2018, for International Application No. PCT/JP2018/006365, with an English translation.

* cited by examiner

COMPRESSOR SUCTION PIPE, COMPRESSION UNIT, AND CHILLER

TECHNICAL FIELD

The present disclosure relates to a suction pipe for a compressor, a compression unit, and a chiller.

BACKGROUND ART

A turbo chiller is a large-capacity heat source machine widely used for large-scale factory air conditioning, district heating and cooling, and other applications, for instance, and it is known that components such as a compressor, a condenser, and an evaporator are densely disposed and integrated into a unit (see Patent Document 1, for instance).

CITATION LIST

Patent Literature

Patent Document 1: JP2011-102668A

SUMMARY

Problems to be Solved

In a turbo chiller, a compressor is often disposed above an evaporator to efficiently place components of the turbo chiller. Accordingly, a refrigerant outlet at an upper part of the evaporator and a suction port of the compressor are connected with a pipe having a bent portion.

In a case where a so-called low pressure refrigerant is used as a refrigerant to be compressed in the turbo chiller, the volume flow rate of the refrigerant increases compared with the case of using a so-called high pressure refrigerant, and the diameter of the pipe connecting the evaporator and the compressor increases accordingly. Since the compressor is disposed above the evaporator as previously described, the pipe connecting the evaporator and the compressor has a short length. Moreover, since the pipe has a bent portion as previously described, the flow of the refrigerant after passing through the bent portion becomes uneven with the increase in diameter of the pipe, which may cause insufficient performance of the compressor.

In view of the above, an object of at least one embodiment of the present invention is to provide a suction pipe for a compressor, a compression unit, and a chiller whereby it is possible to suppress uneven flow of a fluid to be compressed at an inlet of the compressor, and prevent a reduction in performance of the compressor.

Solution to the Problems (1) A compressor suction pipe, connected to a suction side of a compressor which sucks a fluid to be compressed, according to at least one embodiment of the present invention comprises: a bent portion configured to change a flow direction of the fluid from a first direction to a second direction and including at least a first pipe segment on the most upstream side with respect to flow of the fluid, a second pipe segment connected to the suction side of the compressor and extending in a direction different from an extension direction of the first pipe segment, and a third pipe segment disposed between the first pipe segment and the second pipe segment and extending in a direction different from the extension direction of the first pipe segment and from an extension direction of the second pipe segment; and at least one partition extending at least from an intermediate portion of the first pipe segment at least to an intermediate portion of the second pipe segment in the bent portion and dividing an interior of the bent portion. The at least one partition extends in a direction intersecting a virtual plane including an incircle that touches an axis of the first pipe segment on an upstream side of a downstream end of the first pipe segment and touches an axis of the second pipe segment.

With the above configuration (1), it is possible to suppress uneven flow of the fluid to be compressed flowing through the compressor suction pipe into the compressor, and it is possible to prevent a reduction in performance of the compressor.

That is, when a fluid to be compressed flows through a bent pipe, its flow varies between the inner side and the outer side of the bend due to inertia of the fluid. Specifically, the flow velocity of the fluid to be compressed varies by region in a flow passage cross-section. If such a fluid with uneven flow enters the compressor, sufficient performance of the compressor may not be obtained.

In the above configuration (1), the partition extends in a direction intersecting a virtual plane including an incircle that touches the axis of the first pipe segment on the upstream side of the downstream end of the first pipe segment and touches the axis of the second pipe segment. Accordingly, the partition divides the bent portion forming the flow passage for the fluid to be compressed into a flow passage on the inner side with respect to the radial direction of the incircle and a flow passage on the outer side with respect to the radial direction of the incircle. Accordingly, since the partition is positioned on the outer side of the bend in the flow passage positioned on the inner side with respect to the radial direction of the incircle, the partition guides the fluid to be compressed so as to change the flow direction of the fluid from a first direction to a second direction.

Thereby, it is possible to suppress uneven flow of the fluid to be compressed flowing into the compressor, and it is possible to prevent a reduction in performance of the compressor.

(2) In some embodiments, in the above configuration (1), the at least one partition includes an inner partition disposed closer to a center of the incircle than an axis of the bent portion is to the center.

With the above configuration (2), it is possible to suppress uneven flow of the fluid to be compressed flowing into the compressor, and it is possible to prevent a reduction in performance of the compressor.

That is, as described above, when a fluid to be compressed flows through a bent pipe, its flow varies between the inner side and the outer side of the bend due to inertia of the fluid. The variation of flow increases as the flow direction changes steeply, i.e., as the curvature radius of the bent pipe (flow passage) decreases. Further, the variation of flow between the inner side and the outer side of the bend increases as the width of the flow passage connecting the inner side and the outer side of the bend increases.

In the above configuration (2), the inner partition is disposed closer to the center of the incircle than the axis of the bent portion is. Thus, among flow passages in the bent portion divided by the inner partition, the width of the flow passage on the inner side with respect to the radial direction of the incircle is smaller than the width of the other flow passage. That is, with the above configuration (2), by decreasing the width of the flow passage on the inner side with respect to the radial direction of the incircle, which changes the flow direction more steeply than the other flow passage, it is possible to suppress uneven flow in this flow passage, and it is possible to prevent a reduction in performance of the compressor.

(3) In some embodiments, in the above configuration (2), an inner flow passage divided by the inner partition and closest to the center of the incircle is formed in the bent portion, and a flow passage cross-sectional area at a downstream end of the inner flow passage is smaller than a flow passage cross-sectional area at an upstream end of the inner flow passage.

With the above configuration (3), it is possible to control a reduction in flow velocity of the fluid to be compressed at the outlet of the inner flow passage and suppress uneven flow of the fluid to be compressed flowing into the compressor, and thus it is possible to prevent a reduction in performance of the compressor.

That is, since the inner flow passage is the closest to the center of the incircle and thus the flow direction thereof changes more steeply than the other flow passage, less fluid flows into the inner flow passage than the other flow passage, so that the flow velocity of the fluid tends to decrease in the inner flow passage.

However, in the above configuration (3), the flow passage cross-sectional area at the downstream end of the inner flow passage is smaller than the flow passage cross-sectional area at the upstream end of the inner flow passage. As the flow passage cross-sectional area on the downstream side of the inner flow passage decreases, the flow velocity on the downstream side of the inner flow passage increases. Thus, it is possible to control a reduction in flow velocity of the fluid to be compressed at the outlet of the inner flow passage and suppress uneven flow of the fluid flowing into the compressor. Consequently, it is possible to prevent a reduction in performance of the compressor.

(4) In some embodiments, in the above configuration (2) or (3), the at least one partition includes: the inner partition; and an outer partition disposed opposite to the center of the incircle across the axis of the bent portion.

With the above configuration (4), the flow passage on the outer side with respect to the radial direction of the incircle divided by the inner partition is further divided into a flow passage on the inner side with respect to the radial direction of the incircle and a flow passage on the outer side with respect to the radial direction of the incircle. That is, with the above configuration (4), since the width of each flow passage of the bent portion is decreased, it is possible to suppress uneven flow in each flow passage, and it is possible to prevent a reduction in performance of the compressor.

(5) In some embodiments, in any one of the above configurations (2) to (4), the at least one partition extends to an upstream end of the first pipe segment.

With the above configuration (5), since the at least one partition extends to the upstream end of the first pipe segment which is a pipe segment on the most upstream side, it is possible to efficiently guide the fluid to be compressed so as to change the flow direction of the fluid from the first direction to the second direction.

Thus, it is possible to suppress uneven flow of the fluid to be compressed flowing into the compressor, and it is possible to prevent a reduction in performance of the compressor.

(6) In some embodiments, in any one of the above configurations (2) to (5), the at least one partition extends to a downstream end of the second pipe segment.

With the above configuration (6), since the at least one partition extends to the downstream end of the second pipe segment which is a pipe segment connected to the suction side of the compressor, i.e., a pipe segment on the most downstream side, it is possible to efficiently guide the fluid to be compressed so as to change the flow direction of the fluid from the first direction to the second direction.

Thus, it is possible to suppress uneven flow of the fluid to be compressed flowing into the compressor, and it is possible to prevent a reduction in performance of the compressor.

(7) In some embodiments, in any one of the above configurations (2) to (6), the at least one partition includes a protruding portion protruding upstream from an upstream end of the first pipe segment with respect to flow of the fluid.

With the above configuration (7), the protruding portion guides the flow of the fluid to be compressed on the upstream side of the upstream end of the first pipe segment, and uneven flow on the upstream side of the first pipe segment is suppressed. Thus, it is possible to suppress uneven flow of the fluid to be compressed in the compressor suction pipe.

Thus, it is possible to suppress uneven flow of the fluid to be compressed flowing into the compressor, and it is possible to prevent a reduction in performance of the compressor.

(8) In some embodiments, in the above configuration (7), the protruding portion extends in a direction different from the first direction at least on an upstream side with respect to flow of the fluid.

With the above configuration (8), the protruding portion guides the flow of the fluid to be compressed on the upstream side of the upstream end of the first pipe segment, and uneven flow on the upstream side of the first pipe segment is suppressed. Thus, it is possible to suppress uneven flow of the fluid to be compressed in the compressor suction pipe.

Thus, it is possible to suppress uneven flow of the fluid to be compressed flowing into the compressor, and it is possible to prevent a reduction in performance of the compressor.

(9) In some embodiments, in any one of the above configurations (1) to (8), the at least one partition has a flat plate shape in each of the first pipe segment, the second pipe segment, and the third pipe segment.

With the above configuration (9), it is possible to suppress uneven flow of the fluid to be compressed in the compressor suction pipe by the partition having a simple shape. Thus, it is possible to reduce the manufacturing cost of the compressor suction pipe.

That is, the compressor suction pipe is a so-called miter bend formed by connecting a plurality of pipe segments having different extension directions, in which the pipe segments are connected by welding or the like. For instance, by fixing a flat plate-like partition to each pipe segment before connecting the pipe segments, and then connecting the pipe segments mounted with the partition to each other, it is possible to produce the compressor suction pipe at low cost.

(10) A compression unit according to at least one embodiment of the present invention comprises: the compressor suction pipe having any one of the above configuration (1) to (9); the compressor; and a connection target machine connected to an upstream end of the first pipe segment of the compressor suction pipe and containing a fluid to be compressed. The connection target machine has a connection portion connected to the compressor suction pipe, and an opening area of the connection portion on a side of the connection target machine is larger than an opening area of the connection portion on a side of the compressor suction pipe.

With the above configuration (10), since the fluid to be compressed easily flows from the connection target machine to the compressor suction pipe, it is possible to suppress contracted flow in the vicinity of the connection portion, and it is possible to suppress uneven flow.

Thus, it is possible to suppress uneven flow of the fluid to be compressed in the compressor suction pipe and suppress uneven flow of the fluid to be compressed flowing into the compressor, and it is possible to prevent a reduction in performance of the compressor.

(11) In some embodiments, in the above configuration (10), the connection portion has a bell-mouth shape.

With the above configuration (11), since the fluid to be compressed easily flows from the connection target machine to the compressor suction pipe, it is possible to suppress contracted flow in the vicinity of the connection portion, and it is possible to suppress uneven flow.

Thus, it is possible to suppress uneven flow of the fluid to be compressed in the compressor suction pipe and suppress uneven flow of the fluid to be compressed flowing into the compressor, and it is possible to prevent a reduction in performance of the compressor.

(12) A chiller according to at least one embodiment of the present invention comprises: the compressor suction pipe having any one of the above configurations (1) to (9); the compressor for compressing a refrigerant; a condenser for condensing the refrigerant compressed by the compressor; an expander for expanding the refrigerant condensed by the condenser; and an evaporator for evaporating the refrigerant expanded by the expander. The evaporator is connected to an upstream end of the first pipe segment of the compressor suction pipe.

With the above configuration (12), it is possible to suppress uneven flow of the refrigerant flowing into the compressor, and it is possible to prevent a reduction in performance of the compressor. Thus, it is possible to improve the performance and efficiency of the chiller.

(13) In some embodiments, in the above configuration (12), the evaporator has a connection portion connected to the compressor suction pipe, and an opening area of the connection portion on a side of the evaporator is larger than an opening area of the connection portion on a side of the compressor suction pipe.

With the above configuration (13), since the refrigerant easily flows from the evaporator to the compressor suction pipe, it is possible to suppress contracted flow in the vicinity of the upstream end of the compressor suction pipe, and it is possible to suppress uneven flow.

Thus, it is possible to suppress uneven flow of the refrigerant in the compressor suction pipe and suppress uneven flow of the refrigerant flowing into the compressor, and it is possible to prevent a reduction in performance of the compressor. Thus, it is possible to improve the performance and efficiency of the chiller.

(14) In some embodiments in the above configuration (13), the connection portion has a bell-mouth shape.

With the above configuration (14), since the refrigerant easily flows from the evaporator to the compressor suction pipe, it is possible to suppress contracted flow in the vicinity of the upstream end of the compressor suction pipe, and it is possible to suppress uneven flow.

Thus, it is possible to suppress uneven flow of the refrigerant in the compressor suction pipe and suppress uneven flow of the refrigerant flowing into the compressor, and it is possible to prevent a reduction in performance of the compressor. Thus, it is possible to improve the performance and efficiency of the chiller.

Advantageous Effects

According to at least one embodiment of the present invention, it is possible to prevent a reduction in performance of a compressor.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise" "include", "have", "contain" and "constitute" are not intended to be exclusive of other components.

Figure 1:
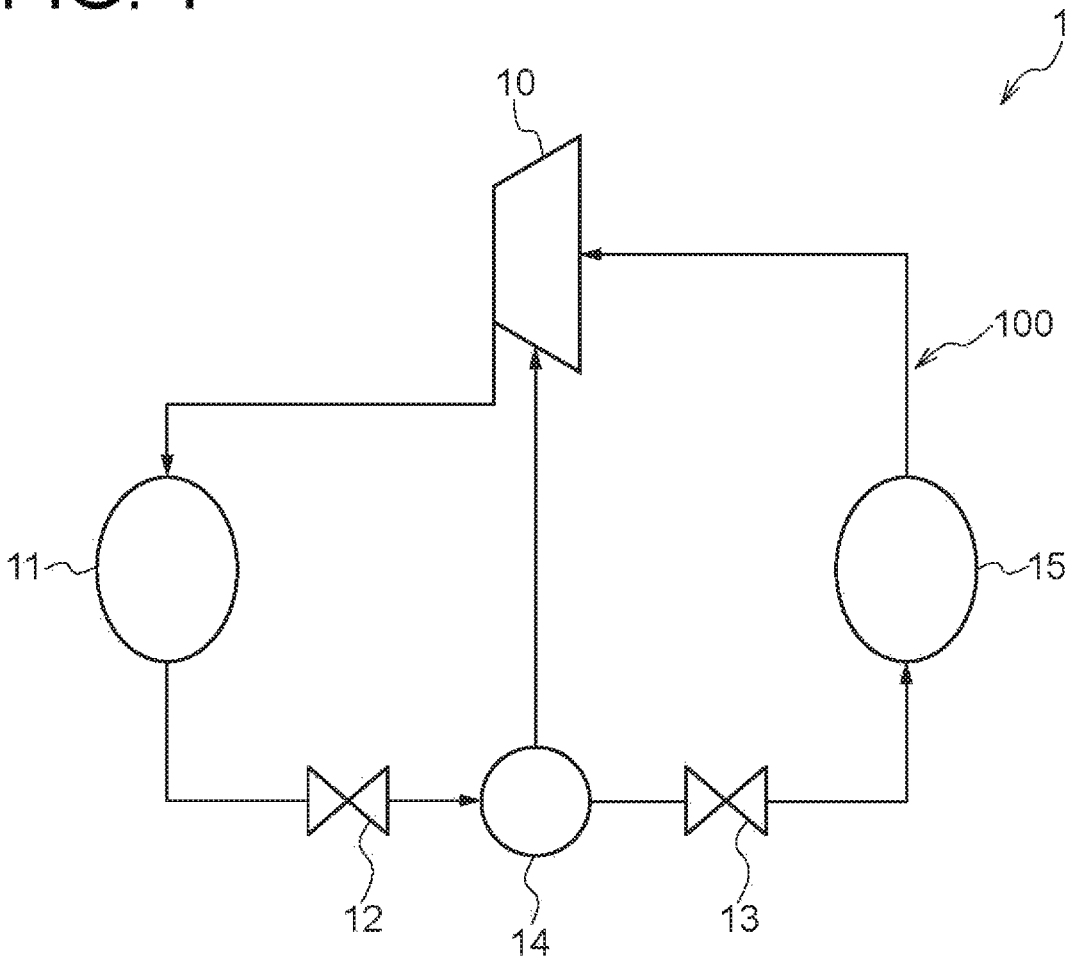
FIG. 1 is an overall system diagram of a turbo chiller according to an embodiment.
Figure 2:
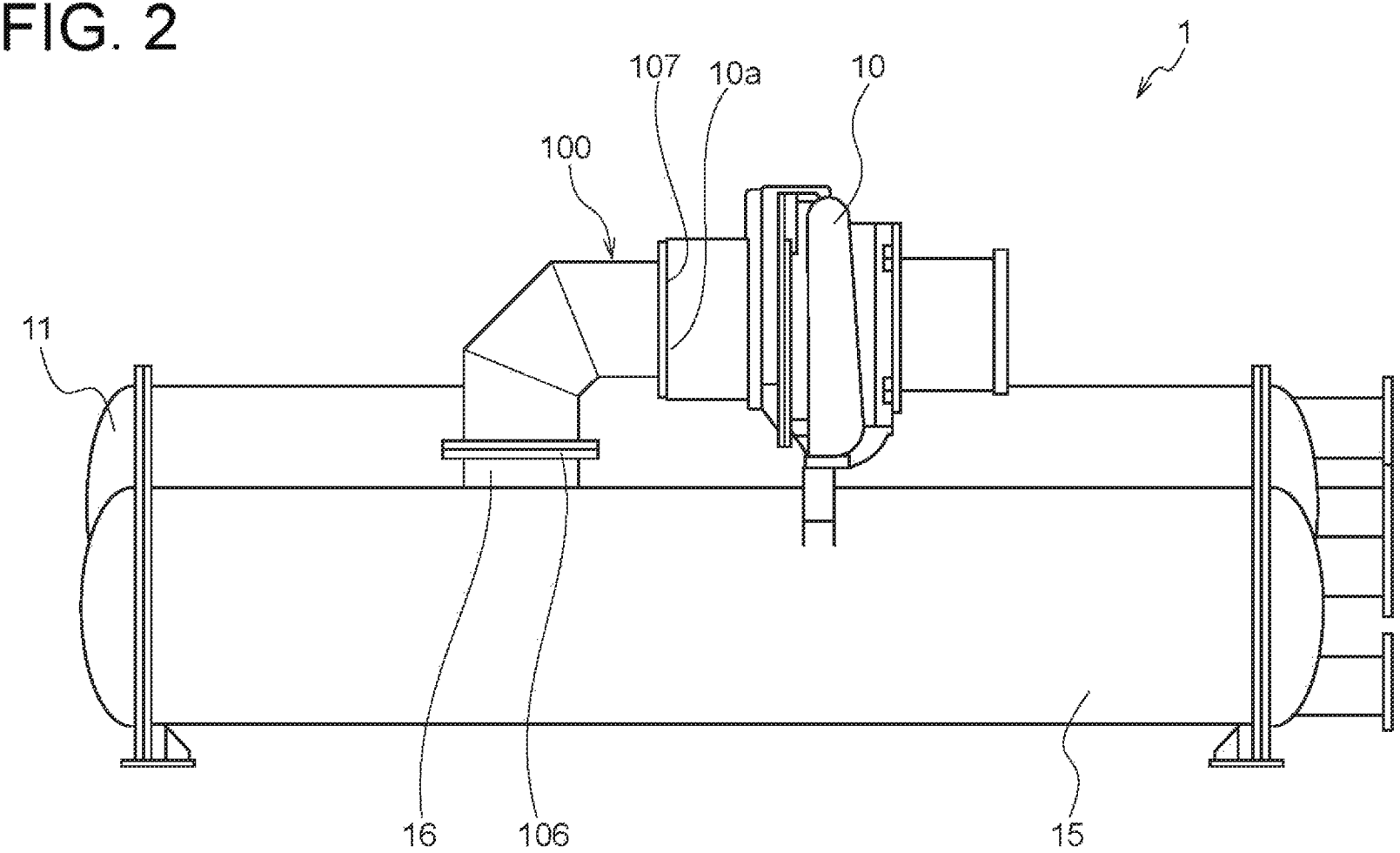
FIG. 2 is an appearance view of a turbo chiller according to an embodiment.

First, a turbo chiller according to an embodiment will be described with reference to FIGS. 1 and 2. FIG. 1 is an overall system diagram of a turbo chiller according to an embodiment. FIG. 2 is an appearance view of a turbo chiller according to an embodiment.

A turbo chiller 1 is a refrigeration device using a turbo compressor such as a centrifugal compressor and is widely used for large-scale factory air conditioning, district heating and cooling, and other applications.

The turbo chiller 1 includes a centrifugal compressor 10 for compressing a refrigerant, a condenser 11 for cooling the compressed refrigerant, a first expansion valve (pressure reducer) 12 for reducing the pressure of the refrigerant from the condenser 11, an economizer (gas-liquid separator) 14 for separating the refrigerant from the first expansion valve 12 into a gas phase and a liquid phase, a second expansion valve (pressure reducer) 13 for reducing the pressure of the liquid phase from the economizer 14, and an evaporator 15 for evaporating the refrigerant from the second expansion valve 13. A connection portion 16 which is the outlet of the refrigerant of the evaporator 15 and a connection portion 10*a* of the centrifugal compressor 10 on the suction side are connected by a compressor suction pipe 100.

In the turbo chiller 1 according to an embodiment, for downsizing the turbo chiller 1, the centrifugal compressor 10 downstream of the evaporator 15 with respect to the flow of the refrigerant is disposed in the vicinity of the evaporator 15, specifically, above the evaporator 15. The evaporator 15 has an appearance of cylindrical shape and is disposed so as to extend in the lateral direction in FIG. 2, i.e., so as to extend in the horizontal direction. Further, the centrifugal compressor 10 is disposed so that a shaft of an impeller (not shown) is oriented in the horizontal direction. The connection portion 16 which is the outlet of the refrigerant from the evaporator 15 to the centrifugal compressor 10 is disposed at an upper part of the evaporator 15.

Accordingly, the compressor suction pipe 100 has a bent pipe shape in which the direction of an end portion on the upstream side (upstream end 106) and the direction of an end portion on the downstream side (downstream end 107) differ from each other by approximately 90 degrees.

In the turbo chiller 1 according to an embodiment, refrigerants having small ozone depletion potential (ODP) and small global warming potential (GWP) are used. Among such refrigerants, the turbo chiller 1 according to an embodiment uses a refrigerant called a low pressure refrigerant. The low pressure refrigerant used in the turbo chiller 1 according to an embodiment has a refrigerant gas density about one fifth of a so-called high pressure refrigerant and a latent heat equal to the high pressure refrigerant, for instance. Accordingly, for obtaining performance equivalent to the case of using the high pressure refrigerant in the turbo chiller, a volume flow rate about five times greater than that with the high pressure refrigerant is required. Thus, it is necessary to increase the flow passage cross-sectional of a portion through which the refrigerant flows.

Therefore, it is also necessary to increase the diameter of the compressor suction pipe 100. However, in a case where a commercially available elbow is used as the compressor suction pipe, a distance between pipe ends increases as the pipe diameter increases. Accordingly, the evaporator 15 and the centrifugal compressor 10 are separated from each other in the vertical direction, and the turbo chiller 1 cannot be downsized. Further, since a horizontal distance between the connection portion 16 of the evaporator 15 and the connection portion 10*a* of the centrifugal compressor 10 on the suction side increases, in a case where two centrifugal compressors 10 are provided as in a large-capacity machine, the two centrifugal compressors 10 cannot be disposed above the evaporator 15.

In view of this, in the turbo chiller 1 according to an embodiment, a bent pipe, called a miter bend, formed by connecting a plurality of straight pipes (pipe segments) obliquely piece by piece is used as the compressor suction pipe 100.

Generally, when a fluid flows through a bent pipe, the flow of the fluid varies between the inner side and the outer side of the bend due to inertia of the fluid. Specifically, the flow velocity of the fluid varies by region in a flow passage cross-section. The same applies to the compressor suction pipe 100. In particular, in the turbo chiller 1 according to an embodiment, since a low pressure refrigerant is used and the diameter of the compressor suction pipe 100 is increased, the variation of the flow of the refrigerant tends to increase between the inner side and outer side of the bend. If such a refrigerant with uneven flow enters the centrifugal compressor 10, sufficient performance of the centrifugal compressor 10 may not be obtained.

In view of this, in the compressor suction pipe 100 according to some embodiments, a partition for dividing the interior of the pipe is provided to guide the flow of the refrigerant by the partition. Thereby, it is possible to suppress uneven flow of the refrigerant flowing into the centrifugal compressor 10, and it is possible to prevent a reduction in performance of the centrifugal compressor 10. In the following, the compressor suction pipe 100 according to some embodiments will be described in detail.

FIGS. 3A to 3H and 4A to 4D are a partial cross-sectional view of the compressor suction pipe 100 according to an embodiment.

In some embodiments, as shown in FIGS. 3A to 3H and 4A to 4D, the compressor suction pipe 100 includes a bent portion 101 which changes the flow direction of the refrigerant from upward to rightward in the figure, an upstream flange portion 103, and a downstream flange portion 104. The compressor suction pipe 100 is joined at the flange portion 103 to the connection portion 16 of the evaporator 15, and joined at the flange portion 104 to the connection portion 10*a* of the centrifugal compressor 10 on the suction side.

The bent portion 101 includes a first pipe segment 110, a second pipe segment 120, and a third pipe segment 130. The first pipe segment 110 is a pipe segment on the most upstream side with respect to the flow of the refrigerant and extends in the up-down direction in the figure. The second pipe segment 120 is connected to the connection portion 10*a* of the centrifugal compressor 10 on the suction side and extend in the right-left direction in the figure. The third pipe segment 130 is disposed between the first pipe segment 110 and the second pipe segment 120 and extends from lower left to upper right in the figure. The refrigerant from the evaporator 15 passes through the first pipe segment 110, the third pipe segment 130, and the second pipe segment 120 in this order in the compressor suction pipe 100 and flows into the centrifugal compressor 10.

In some embodiments, as shown in FIGS. 3A to 3H, the compressor suction pipe 100 includes a partition 150 dividing the interior of the bent portion 101 into a first flow passage 161 and a second flow passage 162. The partition 150 includes a first partition 151, a second partition 152, and a third partition 153.

Further, in some embodiments, as shown in FIGS. 4A to 4D, the compressor suction pipe 100 includes an inner partition 180 and an outer partition 190 dividing the interior of the bent portion 101 into a first flow passage 171, a second flow passage 172, and a third flow passage 173.

First, the partition 150 shown in FIGS. 3A to 3H will be described.

In some embodiments, as shown in FIGS. 3A to 3H, the partition 150 is disposed closer to the center O of the incircle C (see FIG. 3A) than the axis of the bent portion 101, i.e., the axis ax1 of the first pipe segment 110, the axis ax2 of the second pipe segment 120, and the axis ax3 of the third pipe segment 130.

Figure 3A:
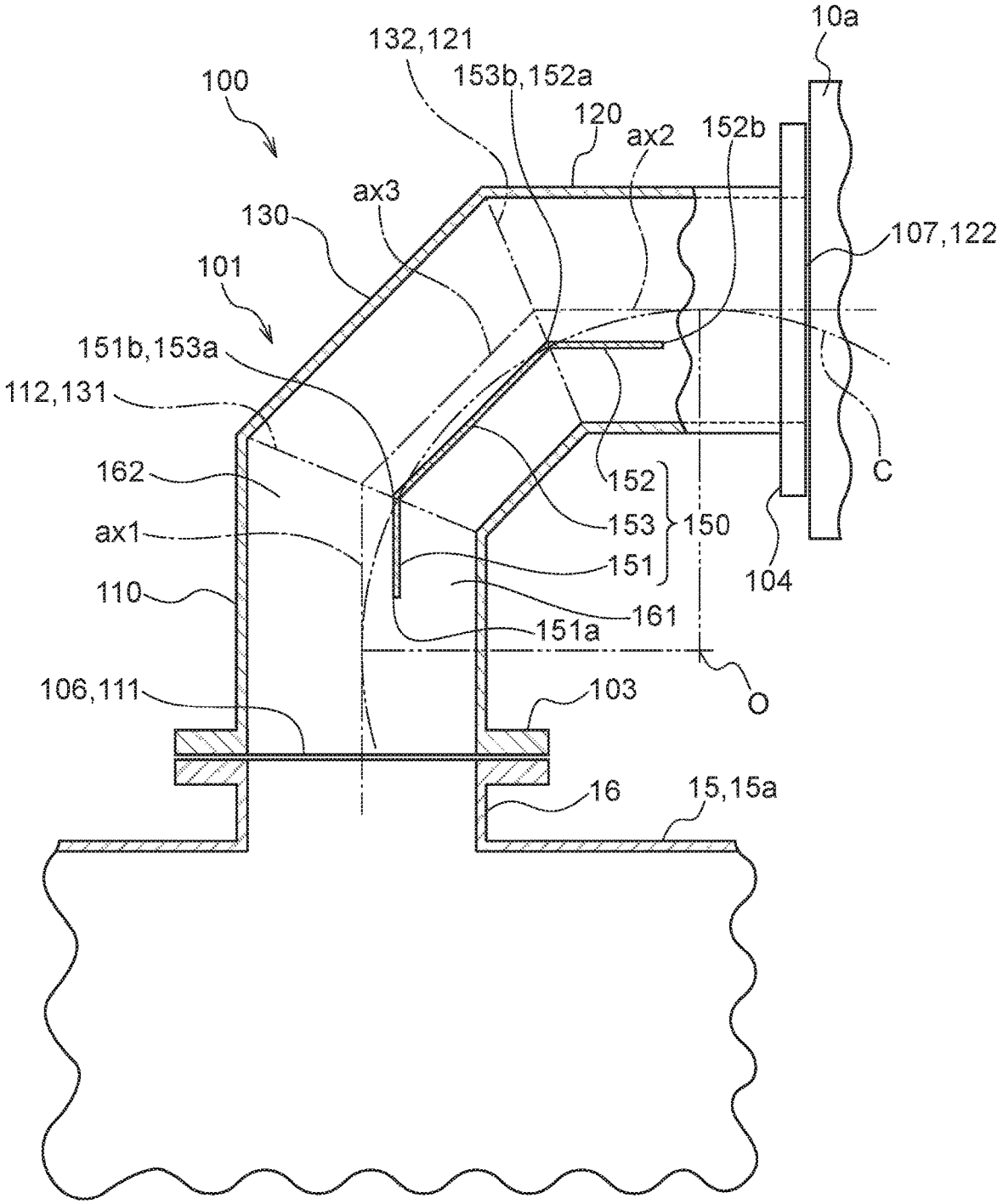
FIG. 3A is a partial cross-sectional view of a compressor suction pipe according to an embodiment.

The incircle C shown in FIG. 3A is an incircle that touches the axis ax1 of the first pipe segment 110 on the upstream side of a downstream end 112 of the first pipe segment 110 and touches the axis ax2 of the second pipe segment 120. In other words, the incircle C is an incircle whose center O is on the inner side of the axis ax3 of the third pipe segment 130 with respect to the bend of the bent portion 101.

In some embodiments, as shown in FIGS. 3A to 3H, the partition 150 includes the first partition 151, the second partition 152, and the third partition 153.

(First Partition 151)

The first partition 151 is a flat plate member disposed within the first pipe segment 110 and extends in an extension direction of the axis ax1 of the first pipe segment 110 and in a direction perpendicular to each plane of FIGS. 3A to 3H. The first partition 151 is disposed in an inner portion of the flow passage inside the axis ax1 of the first pipe segment 110. Hereinafter, the inner portion of the flow passage indicates an inner side with respect to the bend direction of the bent portion 101. Further, an outer portion of the flow passage indicates the outer side with respect to the bend direction of the bent portion 101. For instance, in FIGS. 3A to 3H, the inner portion of the flow passage in the first pipe segment 110 is on the right side in the figure, and the outer portion of the flow passage in the first pipe segment 110 is on the left side in the figure.

Figure 3B:
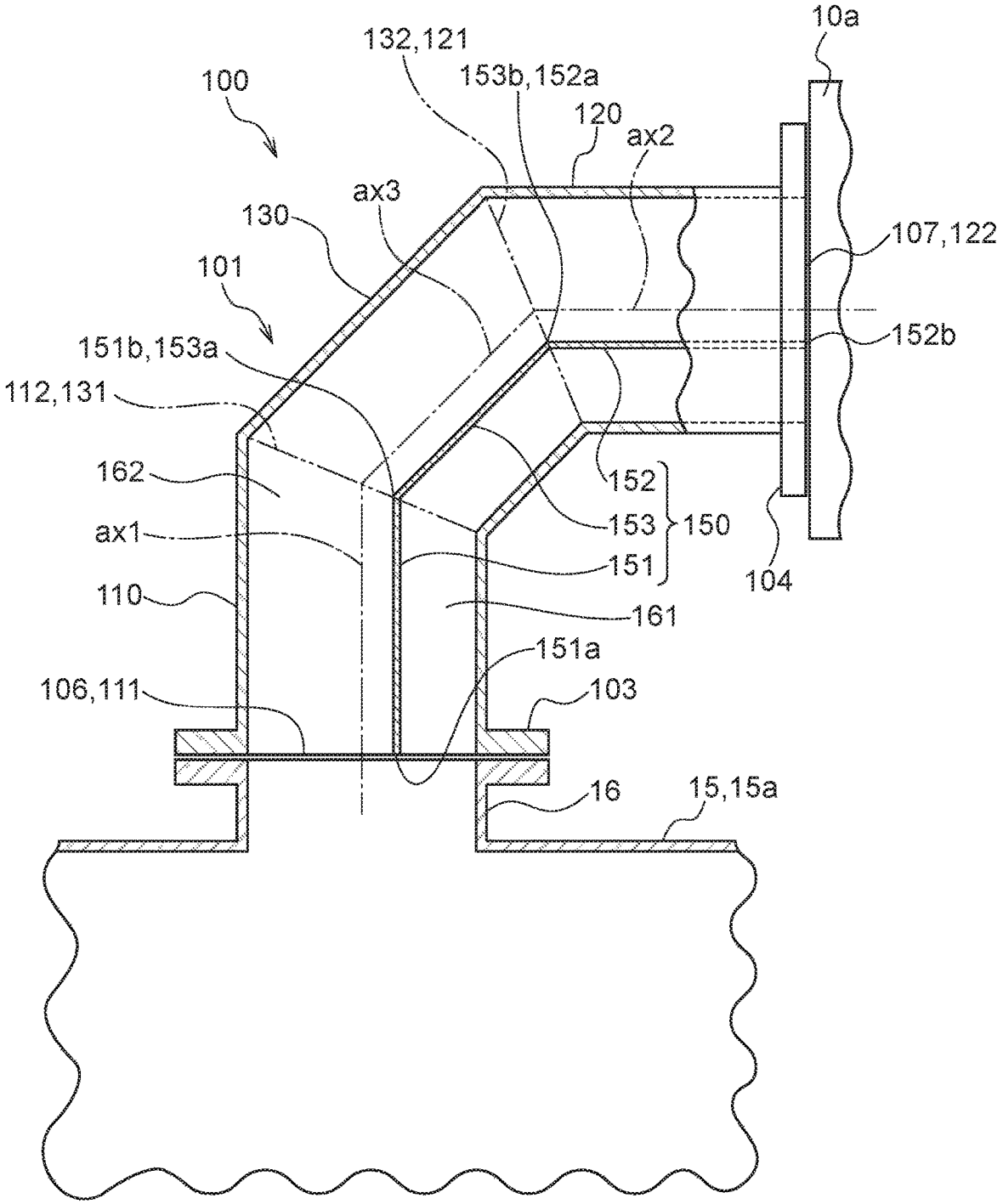
FIG. 3B is a partial cross-sectional view of a compressor suction pipe according to an embodiment.
Figure 3C:
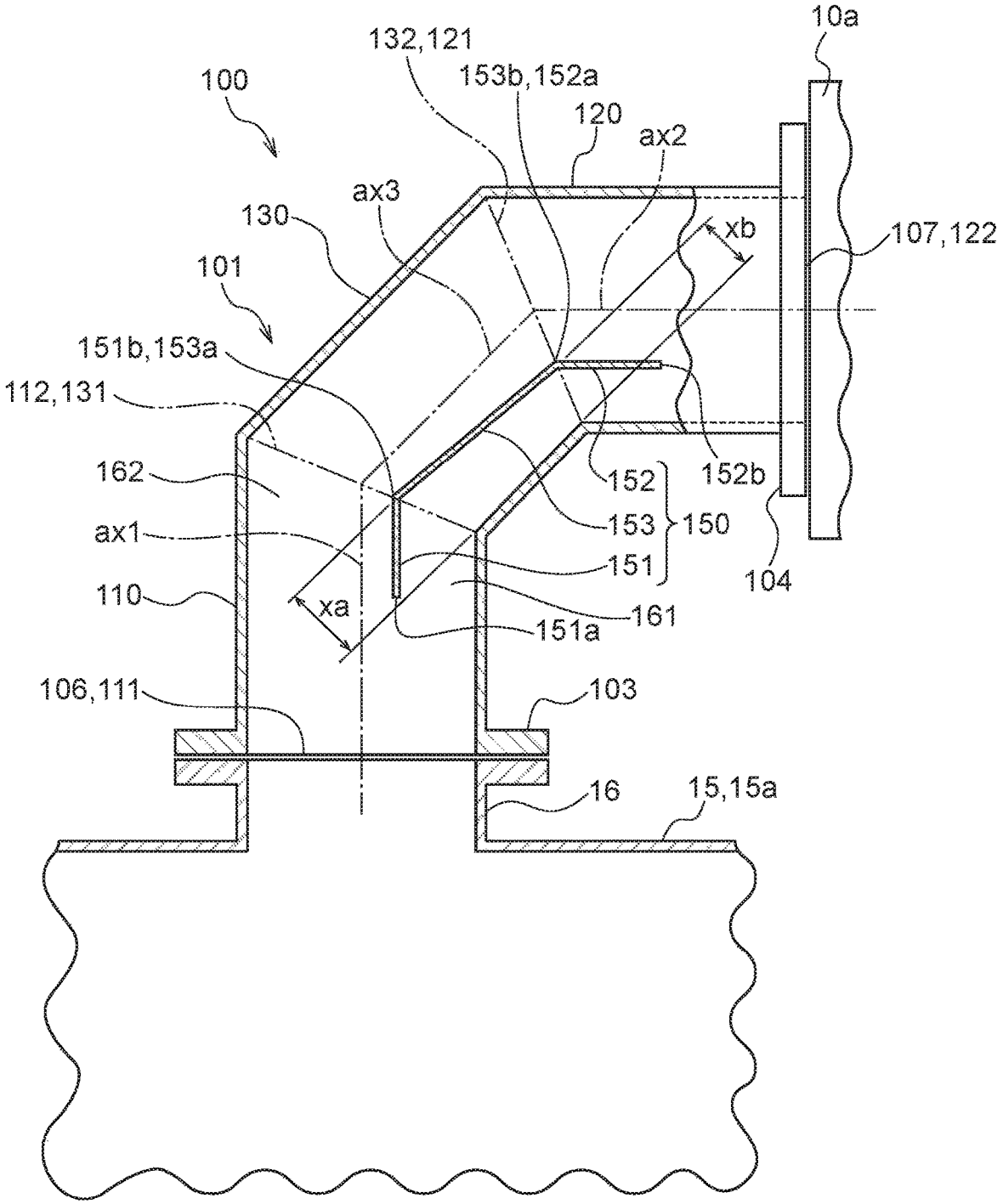
FIG. 3C is a partial cross-sectional view of a compressor suction pipe according to an embodiment.
Figure 3D:
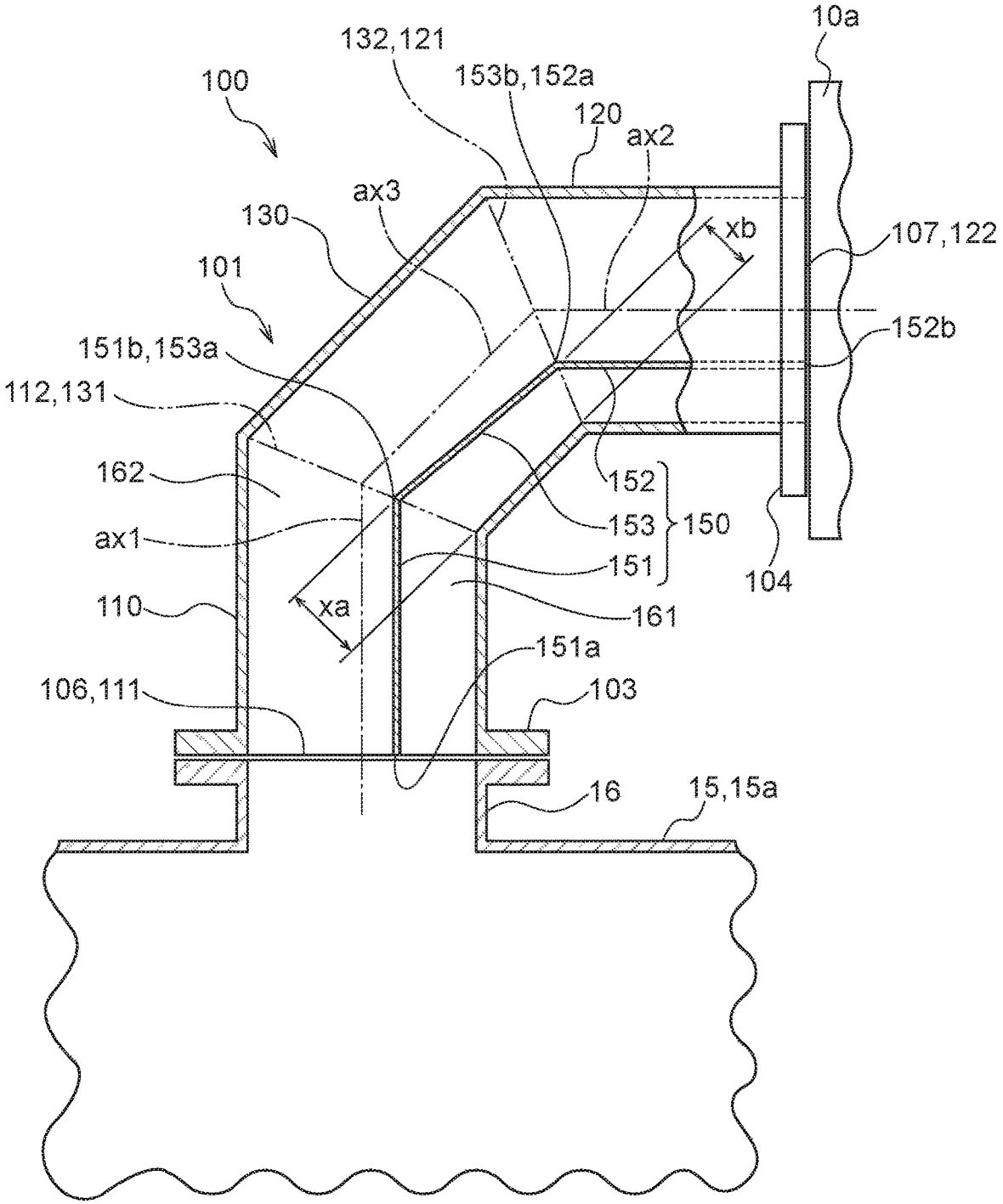
FIG. 3D is a partial cross-sectional view of a compressor suction pipe according to an embodiment.
Figure 3E:
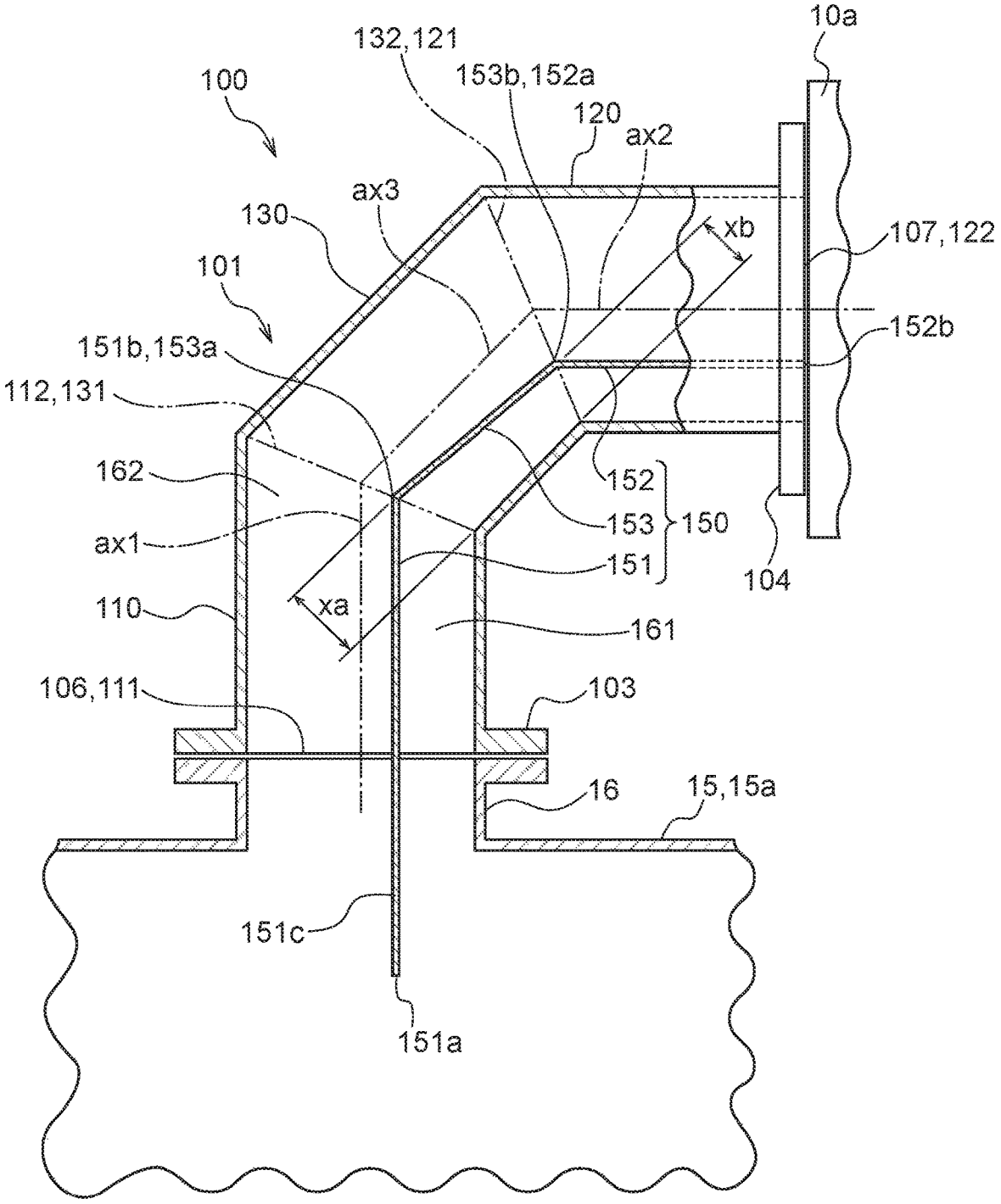
FIG. 3E is a partial cross-sectional view of a compressor suction pipe according to an embodiment.

In some embodiments, as shown in FIGS. 3A and 3C, the first partition 151 extends from an intermediate portion of the first pipe segment 110 to a downstream end 112 of the first pipe segment 110. That is, in some embodiments, an upstream end 151*a* of the first partition 151 is disposed between an upstream end 111 and the downstream end 112 of the first pipe segment 110. Further, in some embodiments, as shown in FIGS. 3B and 3D, the first partition 151 extends from the upstream end 111 of the first pipe segment 110 to the downstream end 112 of the first pipe segment 110.

Further, in some embodiments, as shown in FIGS. 3E to 3H, the first partition 151 extends from the interior of the evaporator 15 to the downstream end 112 of the first pipe segment 110. That is, in some embodiments, as shown in FIGS. 3E to 3H, the upstream end 151*a* of the first partition 151 protrudes from the upstream end 111 of the first pipe segment 110 and is inserted in a space larger than the compressor suction pipe 100, specifically, the evaporator 15. A portion of the first partition 151 protruding from the upstream end 111 of the first pipe segment 110 is referred to as a protruding portion 151*c*.

Although, in some embodiments, as shown in FIGS. 3E to 3H, the upstream end 151*a* of the first partition 151 is inserted in the evaporator 15 through the connection portion 16, the upstream end 151*a* of the first partition 151 may be inserted halfway in the connection portion 16.

Figure 3F:
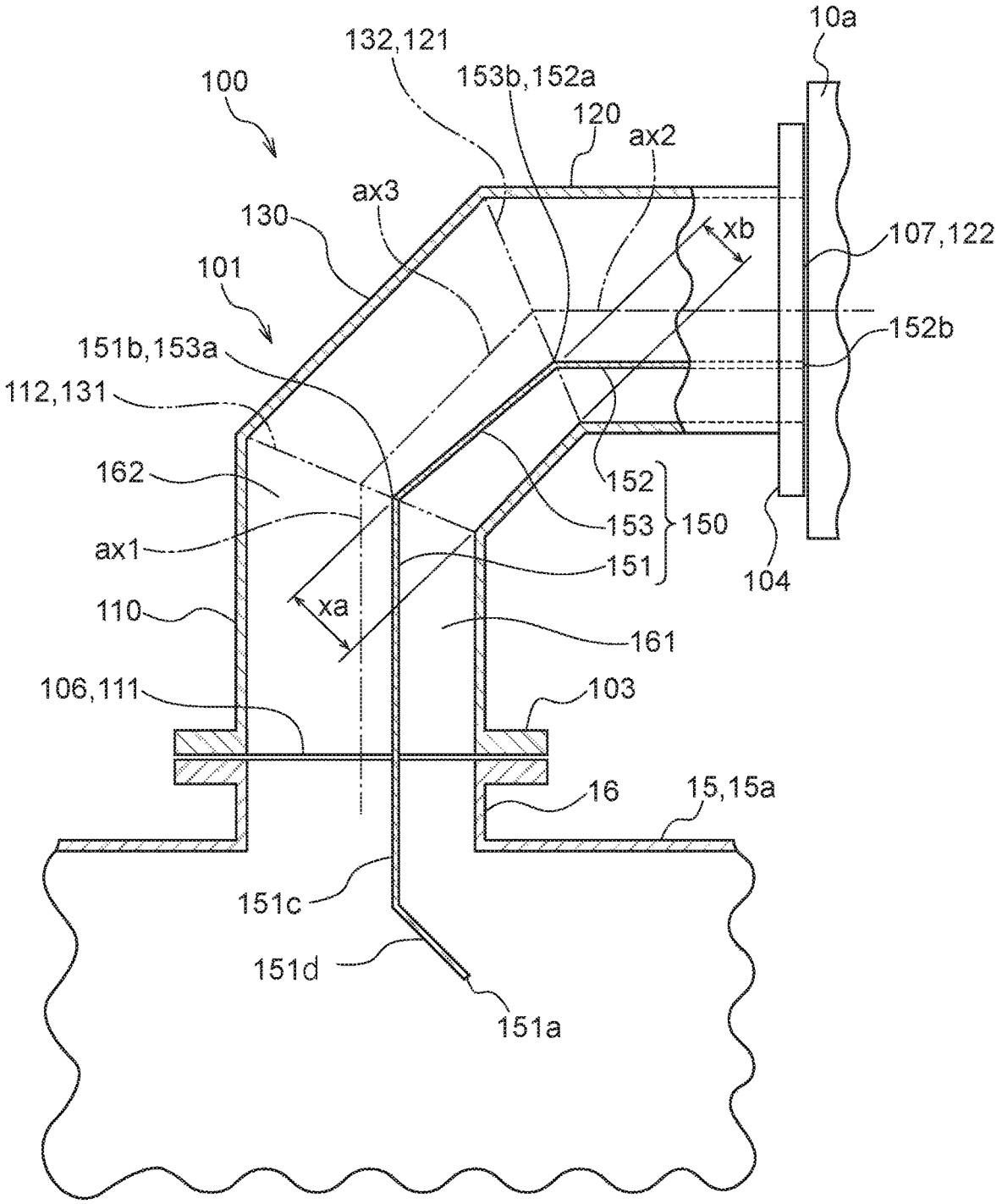
FIG. 3F is a partial cross-sectional view of a compressor suction pipe according to an embodiment.
Figure 3G:
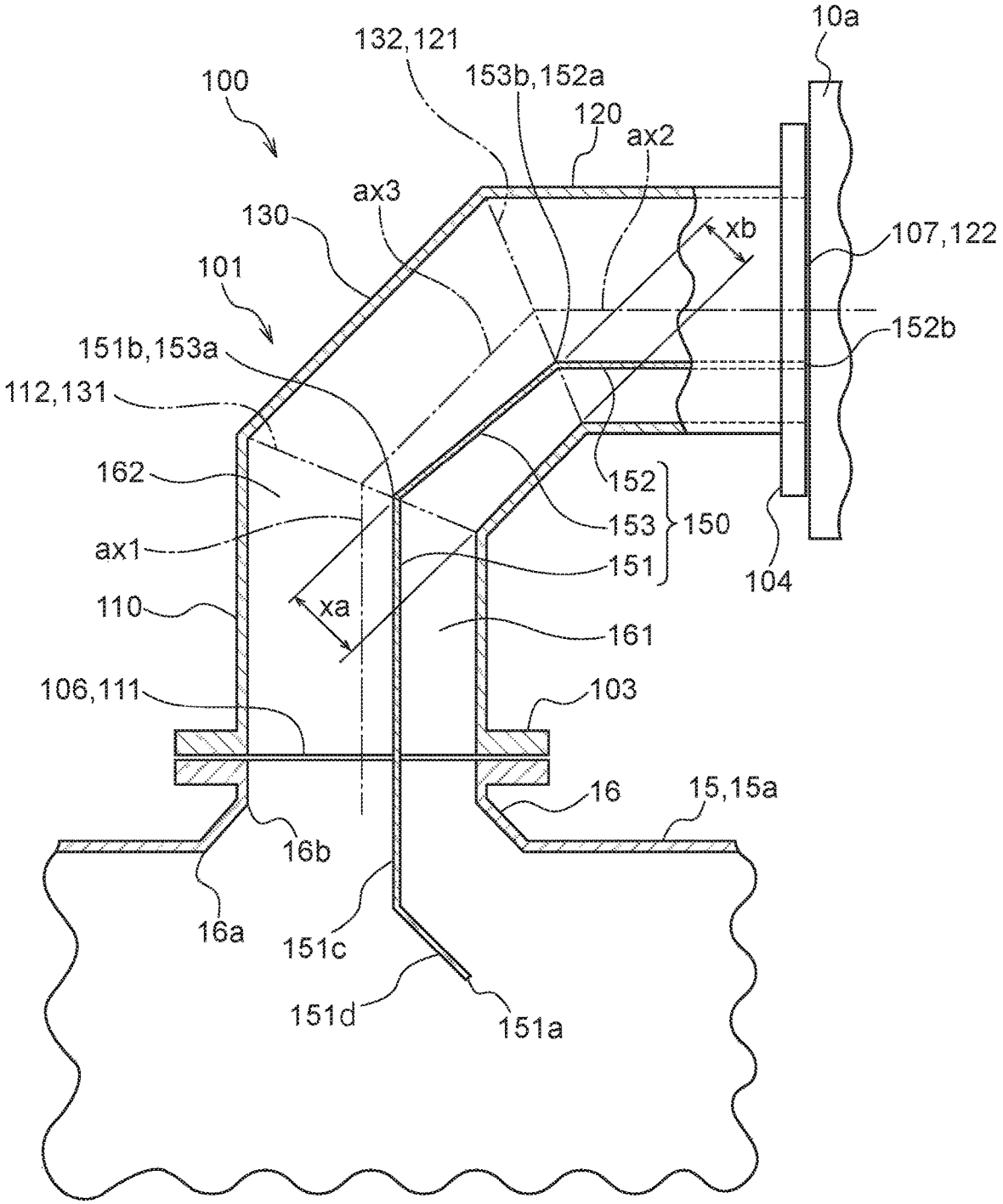
FIG. 3G is a partial cross-sectional view of a compressor suction pipe according to an embodiment.
Figure 3H:
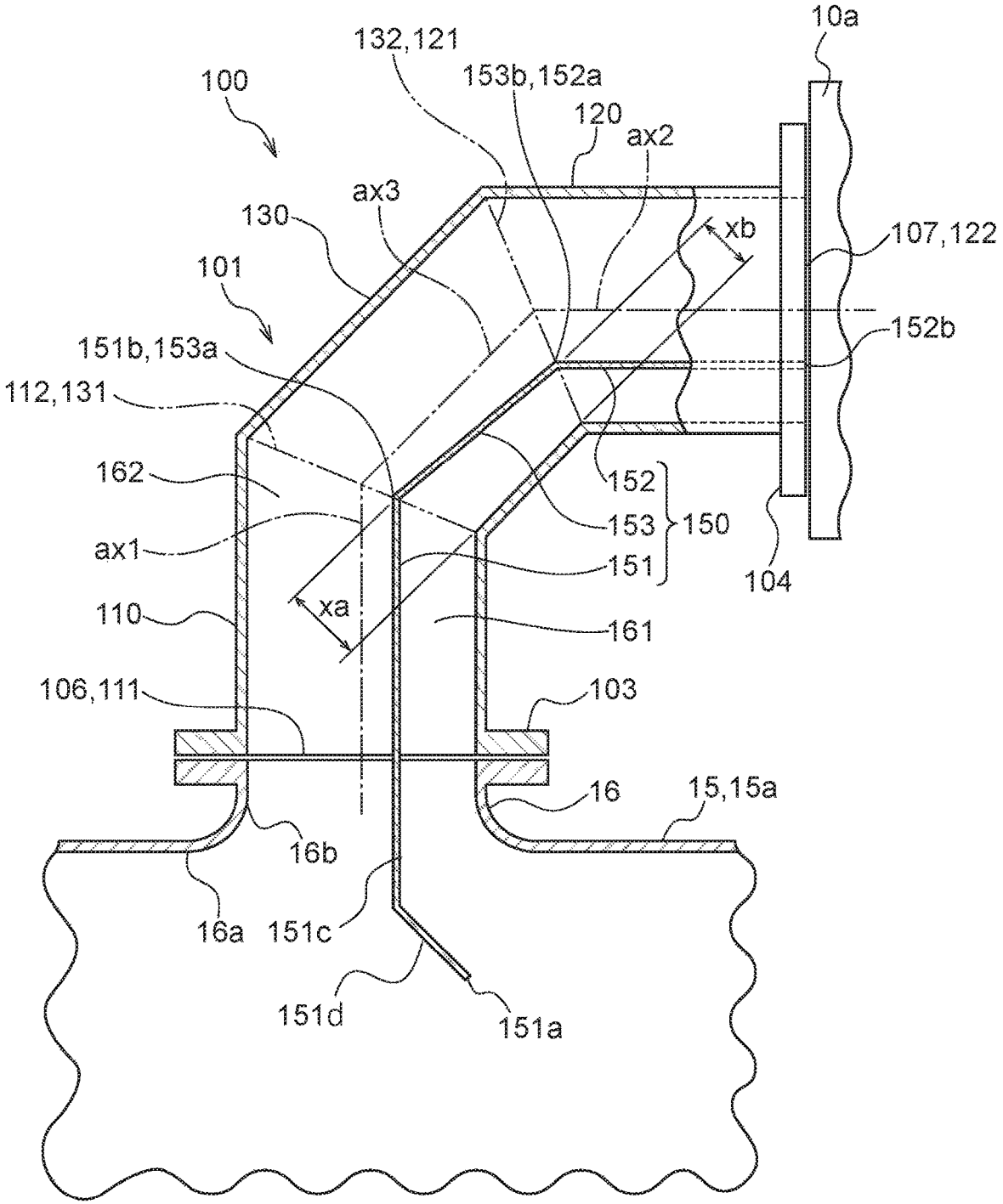
FIG. 3H is a partial cross-sectional view of a compressor suction pipe according to an embodiment.

In some embodiments, as shown in FIGS. 3F to 3H, a distal end portion 151*d* of the protruding portion 151*c* extends in a direction different from the extension direction of the axis ax1 of the first pipe segment 110, specifically, in a direction away from the axis ax1 of the first pipe segment 110.

(Second Partition 152)

The second partition 152 is a flat plate member disposed within the second pipe segment 120 and extends in an extension direction of the axis ax2 of the second pipe segment 120 and in a direction perpendicular to each plane of FIGS. 3A to 3H. The second partition 152 is disposed in an inner portion of the flow passage inside the axis ax2 of the second pipe segment 120. In FIGS. 3A to 3H, the inner portion of the flow passage in the second pipe segment 120 is on the lower side in the figure, and the outer portion of the flow passage in the second pipe segment 120 is on the upper side in the figure.

In some embodiments, as shown in FIGS. 3A and 3C, the second partition 152 extends from an upstream end 121 of the second pipe segment 120 to an intermediate portion of the second pipe segment 120. That is, in some embodiments, a downstream end 152*b* of the second partition 152 is disposed between the upstream end 121 and a downstream end 122 of the second pipe segment 120. Further, in some embodiments, as shown in FIGS. 3B and 3D to 3H, the second partition 152 extends from the upstream end 121 of the second pipe segment 120 to the downstream end 122 of the second pipe segment 120.

(Third Partition 153)

The third partition 153 is a flat plate member disposed within the third pipe segment 130 and extends in a direction perpendicular to each plane of FIGS. 3A to 3H. The third partition 153 is disposed in an inner portion of the flow passage inside the axis ax3 of the third pipe segment 130. In FIGS. 3A to 3H, the inner portion of the flow passage in the third pipe segment 130 is on the lower right side in the figure, and the outer portion of the flow passage in the third pipe segment 130 is on the upper left side in the figure.

In some embodiments, as shown in FIGS. 3A and 3B, the third partition 153 is disposed along the axis ax3 of the third pipe segment 130. Alternatively, in some embodiments, as shown in FIGS. 3C to 3H, the third partition 153 is disposed so that a distance from the axis ax3 of the third pipe segment 130 increases downstream. Accordingly, in some embodiments, as shown in FIGS. 3C to 3H, the width of the first flow passage 161 in the third pipe segment 130 decreases downstream. That is, in some embodiments, as shown in FIGS. 3C to 311, when xa is a flow passage width connecting the inner side and the outer side of the first flow passage 161 at an upstream end 131 of the third pipe segment 130, and xb is a flow passage width connecting the inner side and the outer side of the first flow passage 161 at a downstream end 132, $xb<xa$ is satisfied.

In some embodiments, as shown in FIGS. 3A to 3H, the third partition 153 extends from the upstream end 131 of the third pipe segment 130 to the downstream end 132 of the third pipe segment 130. In some embodiments, as shown in FIGS. 3A to 3H, an upstream end 153*a* of the third partition 153 abuts on a downstream end 151*b* of the first partition 151, and a downstream end 153*b* of the third partition 153 abuts on an upstream end 152*a* of the second partition 152. That is, the partition 150 continues in order of the first partition 151, the third partition 153, and the second partition 152 along the flow direction of the refrigerant. Thus, the partition 150 can guide the flow of the refrigerant like a single continuous partition member.

Within a range of effects described later, the upstream end 153*a* of the third partition 153 may be spaced from the downstream end 151*b* of the first partition 151, and the downstream end 153*b* of the third partition 153 may be spaced from the upstream end 152*a* of the second partition 152.

Although not depicted, the configuration of the second partition 152 and the third partition 153 shown in FIGS. 3B and 3D may be combined with the configuration of the first partition 151 shown in FIG. 3A. Further, although not depicted, the configuration of the second partition 152, the third partition 153, and the connection portion 16 of the evaporator 15 shown in FIGS. 3G and 3H may be combined with the configuration of the first partition 151 shown in FIG. 3A. The same applies to the inner partition 180 and the outer partition 190 described later.

The configuration of the connection portion 16 of the evaporator 15 shown in FIGS. 3G and 3H will be described later.

Although not depicted, the configuration of the first partition 151 and the third partition 153 shown in FIGS. 3B and 3D to 3F may be combined with the configuration of the second partition 152 shown in FIG. 3A. Further, although not depicted, the configuration of the first partition 151, the third partition 153, and the connection portion 16 of the evaporator 15 shown in FIGS. 3G and 3H may be combined with the configuration of the second partition 152 shown in FIG. 3A. The same applies to the inner partition 180 and the outer partition 190 described later.

Next, the inner partition 180 and the outer partition 190 shown in FIGS. 4A to 4D will be described.

In some embodiments, the inner partition 180 is a partition disposed on the inner side with respect the bend direction of the bent portion 101 among two partitions dividing the interior of the bent portion 101 into the first flow passage 171, the second flow passage 172, and the third flow passage 173.

In some embodiments, as shown in FIGS. 4A to 4D, the inner partition 180 is disposed closer to the center O of the incircle C (see FIG. 3A) than the axis of the bent portion 101, i.e., the axis ax1 of the first pipe segment 110, the axis ax2 of the second pipe segment 120, and the axis ax3 of the third pipe segment 130.

In some embodiments, as shown in FIGS. 4A to 4D, the inner partition 180 includes a first partition 181, a second partition 182, and a third partition 183. The inner partition 180 has the same characteristics as the above-described partition 150 and may take all forms of the partition 150. With reference to FIGS. 4A to 4D illustrated as examples, the first partition 181, the second partition 182, and the third partition 183 will now be described.

(First Partition 181)

The first partition 181 has the same characteristics as the above-described first partition 151 of the partition 150.

More specifically, the first partition 181 is a flat plate member disposed within the first pipe segment 110 and extends in the extension direction of the axis ax1 of the first pipe segment 110 and in a direction perpendicular to each plane of FIGS. 4A to 4D. The first partition 181 is disposed in an inner portion of the flow passage inside the axis ax1 of the first pipe segment 110.

Figure 4A:
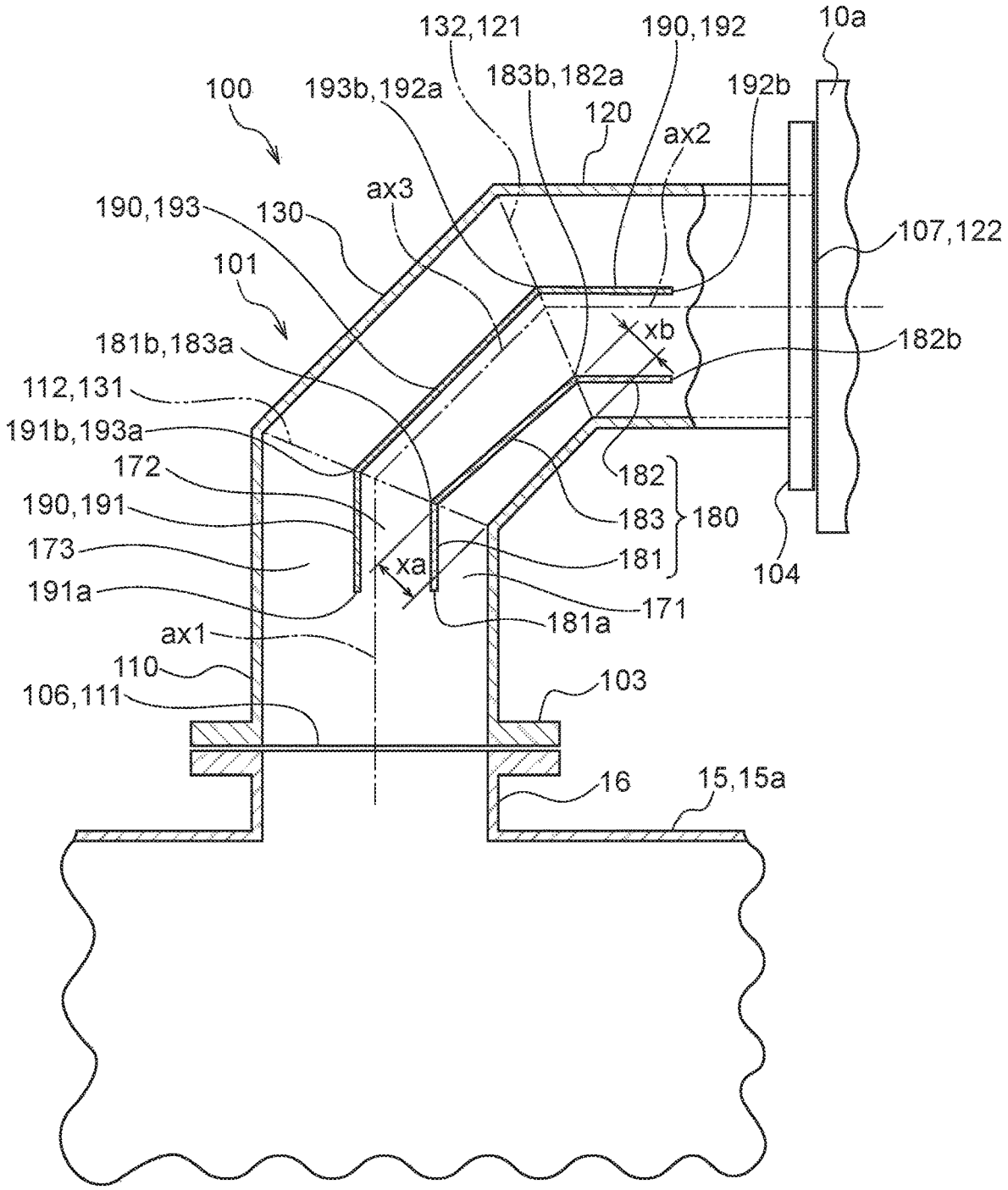
FIG. 4A is a partial cross-sectional view of a compressor suction pipe according to an embodiment.
Figure 4B:
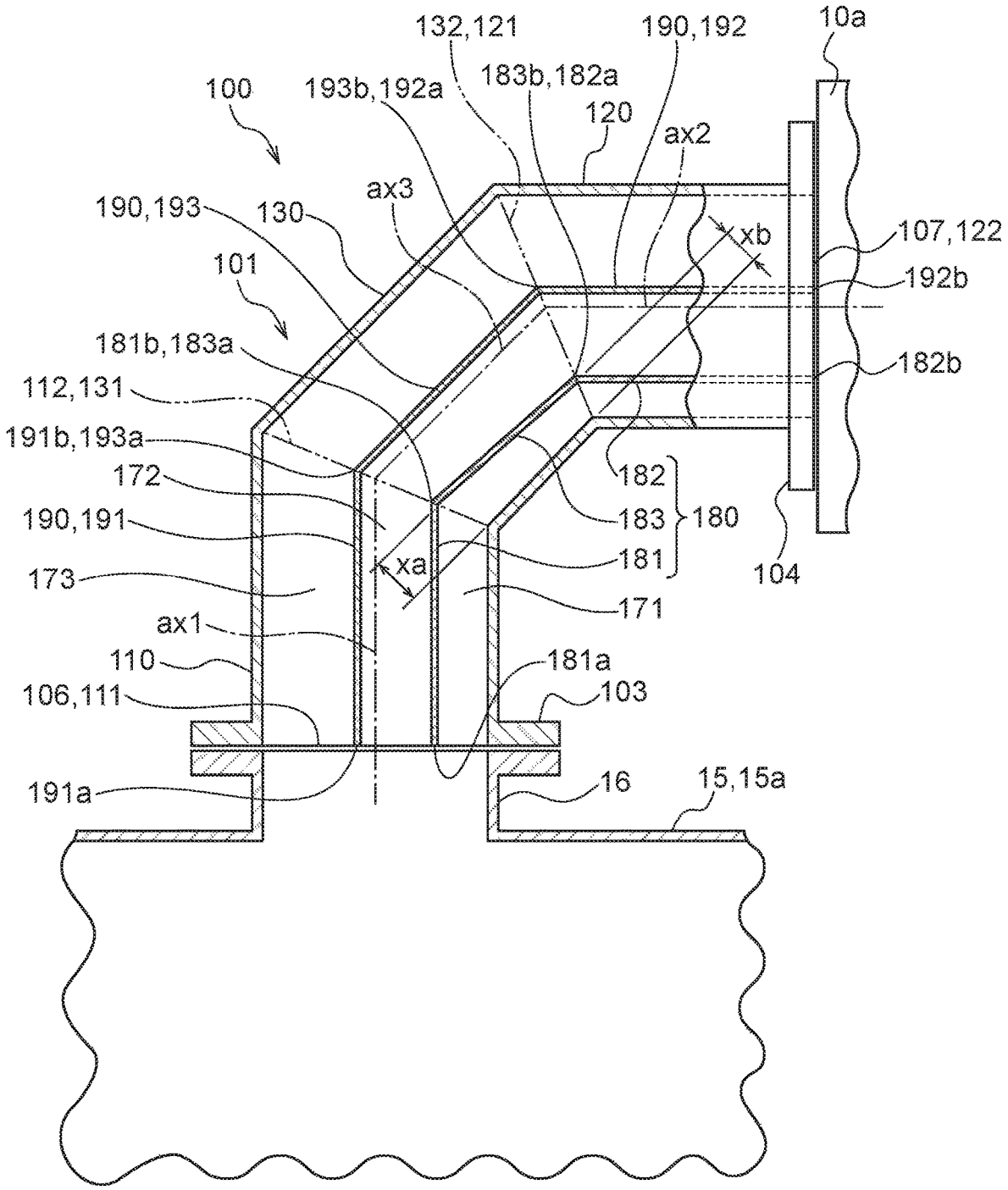
FIG. 4B is a partial cross-sectional view of a compressor suction pipe according to an embodiment.

In some embodiments, as shown in FIG. 4A, the first partition 181 extends from an intermediate portion of the first pipe segment 110 to the downstream end 112 of the first pipe segment 110. That is, in some embodiments, an upstream end 181*a* of the first partition 181 is disposed between the upstream end III and the downstream end 112 of the first pipe segment 110. Further, in some embodiments, as shown in FIG. 4B, the first partition 181 extends from the upstream end 111 of the first pipe segment 110 to the downstream end 112 of the first pipe segment 110.

Figure 4C:
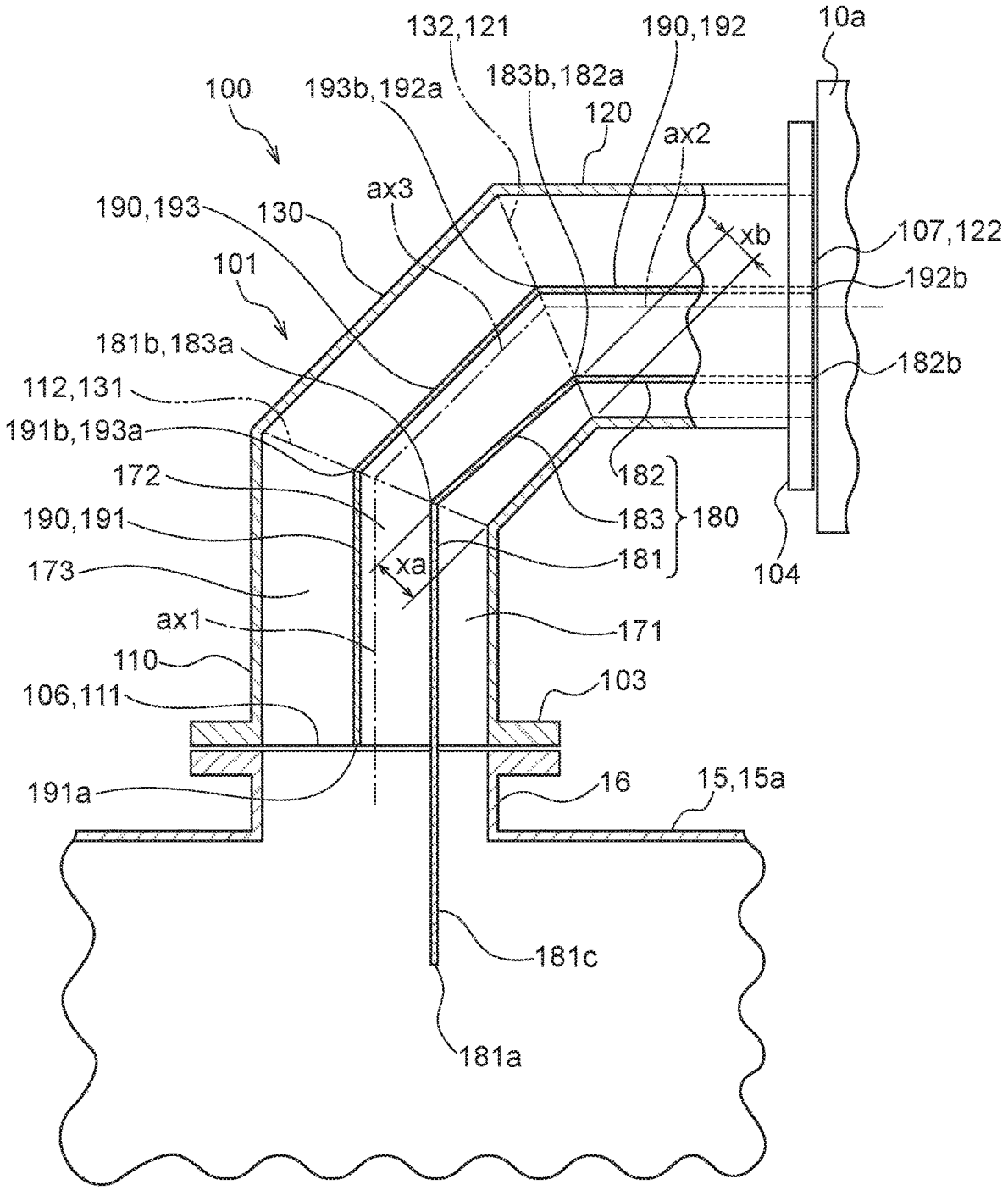
FIG. 4C is a partial cross-sectional view of a compressor suction pipe according to an embodiment.
Figure 4D:
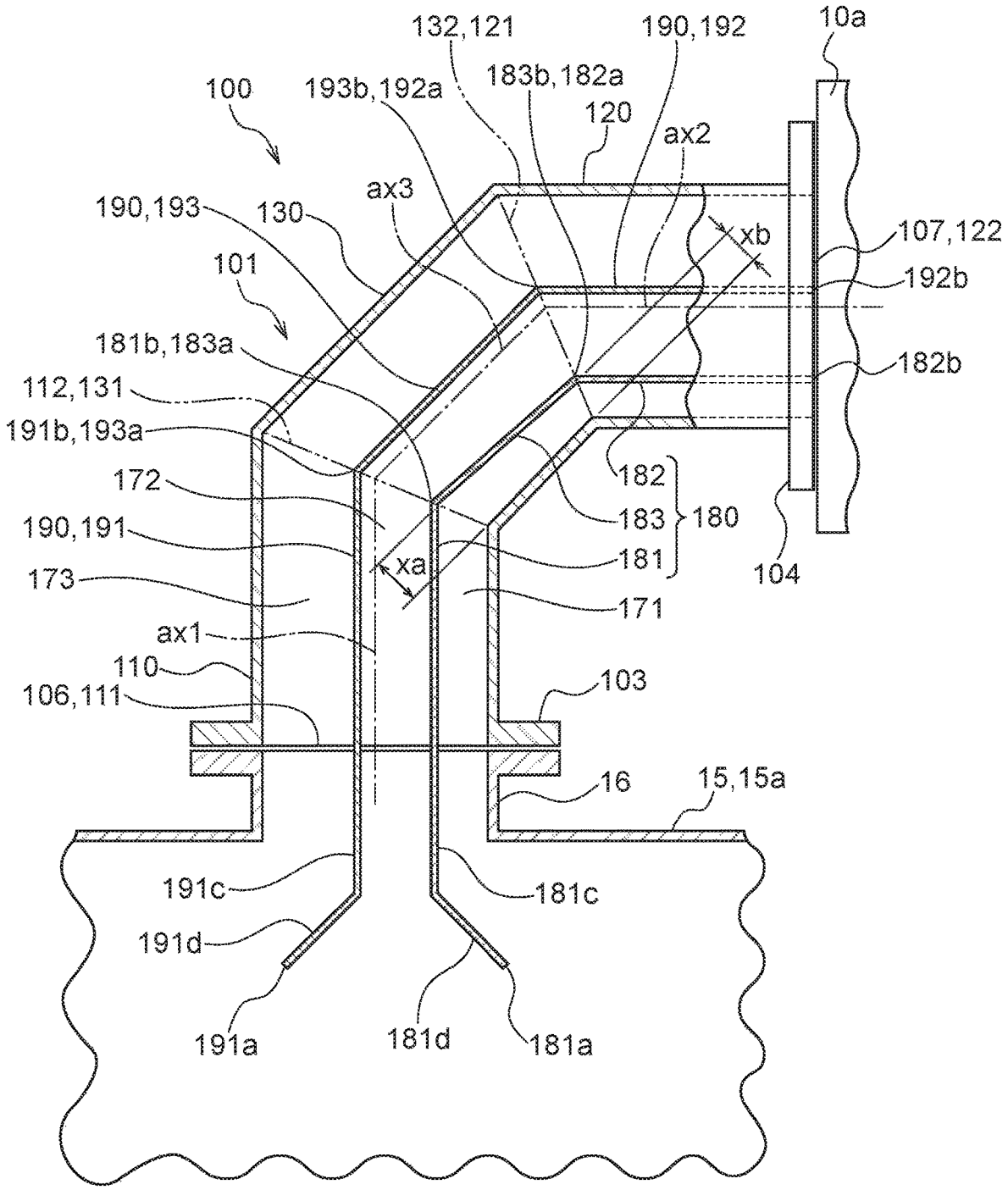
FIG. 4D is a partial cross-sectional view of a compressor suction pipe according to an embodiment.

Further, in some embodiments, as shown in FIGS. 4C and 4D, the first partition 181 extends from the interior of the evaporator 15 to the downstream end 112 of the first pipe segment 110. That is, in some embodiments, as shown in FIGS. 4C and 4D, the upstream end 181*a* of the first partition 181 protrudes from the upstream end 111 of the first pipe segment 110 and is inserted in the evaporator 15. A portion of the first partition 181 protruding from the upstream end 111 of the first pipe segment 110 is referred to as a protruding portion 181*c*.

Although, in some embodiments, as shown in FIGS. 4C and 4D, the upstream end 181*a* of the first partition 181 is inserted in the evaporator 15 through the connection portion 16, the upstream end 181*a* of the first partition 181 may be inserted halfway in the connection portion 16.

In some embodiments, as shown in FIG. 4D, a distal end portion 181*d* of the protruding portion 181*c* extends in a direction different from the extension direction of the axis ax1 of the first pipe segment 110, specifically, in a direction away from the axis ax1 of the first pipe segment 110.

(Second Partition 182)

The second partition 182 has the same characteristics as the above-described second partition 152 of the partition 150.

More specifically, the second partition 182 is a flat plate member disposed within the second pipe segment 120 and extends in the extension direction of the axis ax2 of the second pipe segment 120 and in a direction perpendicular to each plane of FIGS. 4A to 4D. The second partition 182 is disposed in an inner portion of the flow passage inside the axis ax2 of the second pipe segment 120.

In some embodiments, as shown in FIG. 4A, the second partition 182 extends from the upstream end 121 of the second pipe segment 120 to an intermediate portion of the second pipe segment 120. That is, in some embodiments, a downstream end 182*b* of the second partition 182 is disposed between the upstream end 121 and the downstream end 122 of the second pipe segment 120. Further, in some embodiments, as shown in FIGS. 4B to 4D, the second partition 182 extends from the upstream end 121 of the second pipe segment 120 to the downstream end 122 of the second pipe segment 120.

(Third Partition 183)

The third partition 183 has the same characteristics as the above-described third partition 153 of the partition 150.

More specifically, the third partition 183 is a flat plate member disposed within the third pipe segment 130 and extends in a direction perpendicular to each plane of FIGS. 4A to 4D. The third partition 183 is disposed in an inner portion of the flow passage inside the axis ax3 of the third pipe segment 130.

In some embodiments, as shown in FIGS. 4A to 4D, the third partition 183 is disposed so that a distance from the axis ax3 of the third pipe segment 130 increases downstream. Accordingly, in some embodiments, as shown in FIGS. 4A to 4D, the width of the first flow passage 171 in the third pipe segment 130 decreases downstream. That is, in some embodiments, as shown in FIGS. 4A to 4D, when xa is a flow passage width connecting the inner side and the outer side of the first flow passage 171 at the upstream end 131 of the third pipe segment 130, and xb is a flow passage width connecting the inner side and the outer side of the first flow passage 171 at the downstream end 132, xb<xa is satisfied.

In some embodiments, although not depicted, the third partition 183 is disposed parallel to the axis ax3 of the third pipe segment 130, and xa=xb is satisfied.

In some embodiments, as shown in FIGS. 4A to 4D, the third partition 183 extends from the upstream end 131 of the third pipe segment 130 to the downstream end 132 of the third pipe segment 130. In some embodiments, as shown in FIGS. 4A to 4D, an upstream end 183*a* of the third partition 183 abuts on a downstream end 181*b* of the first partition 181, and a downstream end 183*b* of the third partition 183 abuts on an upstream end 182*a* of the second partition 182. That is, the inner partition 180 continues in order of the first partition 181, the third partition 183, and the second partition 182 along the flow direction of the refrigerant. Thus, the inner partition 180 can guide the flow of the refrigerant like a single continuous partition member.

Within a range of effects described later, the upstream end 183*a* of the third partition 183 may be spaced from the downstream end 181*b* of the first partition 181, and the downstream end 183*b* of the third partition 183 may be spaced from the upstream end 182*a* of the second partition 182.

The outer partition 190 will now be described.

In some embodiments, the outer partition 190 is a partition disposed on the outer side with respect the bend direction of the bent portion 101 among two partitions dividing the interior of the bent portion 101 into the first flow passage 171, the second flow passage 172, and the third flow passage 173.

In some embodiments, as shown in FIGS. 4A to 4D, the outer partition 190 is disposed opposite to the center O of the incircle C (see FIG. 3A) across the axis of the bent portion 101.

In some embodiments, as shown in FIGS. 4A to 4D, the outer partition 190 includes a first partition 191, a second partition 192, and a third partition 193. The outer partition 190 has the same characteristics as the above-described partition 150. With reference to FIGS. 4A to 4D illustrated as examples, the first partition 191, the second partition 192, and the third partition 193 will now be described.

(First Partition 191)

The first partition 191 is a flat plate member disposed within the first pipe segment 110 and extends in the extension direction of the axis ax1 of the first pipe segment 110 and in a direction perpendicular to each plane of FIGS. 4A to 4D. The first partition 191 is disposed in an outer portion of the flow passage outside the axis ax1 of the first pipe segment 110.

In some embodiments, as shown in FIG. 4A, the first partition 191 extends from an intermediate portion of the first pipe segment 110 to the downstream end 112 of the first pipe segment 110. That is, in some embodiments, an upstream end 191*a* of the first partition 191 is disposed between the upstream end 111 and the downstream end 112 of the first pipe segment 110. Further, in some embodiments, as shown in FIGS. 4B and 4C, the first partition 191 extends from the upstream end 111 of the first pipe segment 110 to the downstream end 112 of the first pipe segment 110.

Further, in some embodiments, as shown in FIG. 4D, the first partition 191 extends from the interior of the evaporator 15 to the downstream end 112 of the first pipe segment 110. That is, in some embodiments, as shown in FIG. 4D, the upstream end 191*a* of the first partition 191 protrudes from the upstream end 111 of the first pipe segment 110 and is inserted in the evaporator 15. A portion of the first partition 191 protruding from the upstream end 111 of the first pipe segment 110 is referred to as a protruding portion 191*c*.

Although, in some embodiments, as shown in FIG. 4D, the upstream end 191*a* of the first partition 191 is inserted in the evaporator 15 through the connection portion 16, the upstream end 191*a* of the first partition 191 may be inserted halfway in the connection portion 16.

In some embodiments, as shown in FIG. 4D, a distal end portion 191*d* of the protruding portion 191*c* extends in a direction different from the extension direction of the axis ax1 of the first pipe segment 110, specifically, in a direction away from the axis ax1 of the first pipe segment 110.

In some embodiments, although not depicted, the distal end portion 191*d* of the protruding portion 191*c* extends in the same direction as the extension direction of the axis ax1 of the first pipe segment 110. That is, in some embodiments not depicted, the distal end portion 191*d* of the protruding portion 191*c* extends downward in the figure, as the first partition 181 of the inner partition 180 shown in FIG. 4C extends.

(Second Partition 192)

The second partition 192 is a flat plate member disposed within the second pipe segment 120 and extends in the extension direction of the axis ax2 of the second pipe segment 120 and in a direction perpendicular to each plane of FIGS. 4A to 4D. The second partition 192 is disposed in an outer portion of the flow passage outside the axis ax2 of the second pipe segment 120.

In some embodiments, as shown in FIG. 4A, the second partition 192 extends from the upstream end 121 of the second pipe segment 120 to an intermediate portion of the second pipe segment 120. That is, in some embodiments, a downstream end 192*b* of the second partition 192 is disposed between the upstream end 121 and the downstream end 122 of the second pipe segment 120. Further, in some embodiments, as shown in FIGS. 4B to 4D, the second partition 192 extends from the upstream end 121 of the second pipe segment 120 to the downstream end 122 of the second pipe segment 120.

(Third Partition 193)

The third partition 193 is a flat plate member disposed within the third pipe segment 130 and extends in the extension direction of the axis ax3 of the third pipe segment 130 and in a direction perpendicular to each plane of FIGS. 4A to 4D. The third partition 193 is disposed in an outer portion of the flow passage outside the axis ax3 of the third pipe segment 130.

In some embodiments, as shown in FIGS. 4A to 4D, the third partition 193 extends from the upstream end 131 of the third pipe segment 130 to the downstream end 132 of the third pipe segment 130. In some embodiments, as shown in FIGS. 4A to 4D, an upstream end 193*a* of the third partition 193 abuts on a downstream end 191*b* of the first partition 191, and a downstream end 193*b* of the third partition 193 abuts on an upstream end 192*a* of the second partition 192. That is, the outer partition 190 continues in order of the first partition 191, the third partition 193, and the second partition 192 along the flow direction of the refrigerant. Thus, the outer partition 190 can guide the flow of the refrigerant like a single continuous partition member.

Within a range of effects described later, the upstream end 193*a* of the third partition 193 may be spaced from the downstream end 191*b* of the first partition 191, and the downstream end 193*b* of the third partition 193 may be spaced from the upstream end 192*a* of the second partition 192.

Although not depicted, the first partition 191 may be disposed so that a distance from the axis ax1 of the first pipe segment 110 increases or decreases downstream. Similarly, the second partition 192 may be disposed so that a distance from the axis ax2 of the second pipe segment 120 increases or decreases downstream. Similarly, the third partition 193 may be disposed so that a distance from the axis ax3 of the third pipe segment 130 increases or decreases downstream.

Combination of the inner partition 180 and the outer partition 190 in some embodiments is not limited to the above-described combinations shown in FIGS. 4A to 4D. That is, any of the embodiments regarding the inner partition 180 may be combined with any of the embodiments regarding the outer partition 190 as appropriate.

The connection portion 16 of the evaporator 15 will now be described.

In some embodiments, as shown in FIGS. 3A to 3F, the connection portion 16 of the evaporator 15 includes a nozzle-like short pipe protruding from a cylindrical body portion 15*a* of the evaporator 15. Alternatively, in some embodiments, as shown in FIG. 3G, the connection portion 16 of the evaporator 15 has a funnel shape in which the opening area of an opening 16*a* on the evaporator 15 side is larger than the opening area of an opening 16*b* on the compressor suction pipe 100 side. Alternatively, in some embodiments, as shown in FIG. 3H, the connection portion 16 of the evaporator 15 has a bell-mouth shape in which the opening area of an opening 16*a* on the evaporator 15 side is larger than the opening area of an opening 16*b* on the compressor suction pipe 100 side.

Although not depicted, any of the embodiments regarding the evaporator 15 including the connection portion 16 shown in FIGS. 3G and 3H may be combined with any of the embodiments regarding the compressor suction pipe 100 shown in FIGS. 3A to 3F or the compressor suction pipe 100 shown in FIGS. 4A to 4D as appropriate.

The flow of the refrigerant flowing through the compressor suction pipe 100 will now be described.

In some embodiments, as shown in FIGS. 3A to 3H and 4A to 4D, the compressor suction pipe 100 includes the partition 150 and the inner partition 180 extending from at least an intermediate portion of the first pipe segment 110 to at least an intermediate portion of the second pipe segment 120 in the bent portion 101 and dividing the interior of the bent portion 101. The partition 150 and the inner partition 180 extend in a direction perpendicular to a virtual plane including the incircle C (see FIG. 3A) that touches the axis ax1 of the first pipe segment 110 on the upstream side of the downstream end 112 of the first pipe segment 110 and touches the axis ax2 of the second pipe segment 120. When the axis ax1 of the first pipe segment and the axis ax2 of the second pipe segment 120 are present on the same plane as the plane of FIGS. 3A to 3H and 4A to 4D, the virtual plane is on the same plane as the plane of FIGS. 3A to 3H and 4A to 4D.

Accordingly, with the compressor suction pipe 100 according to some embodiments, it is possible to suppress uneven flow of the refrigerant flowing through the compressor suction pipe 100 into the centrifugal compressor 10, and it is possible to prevent a reduction in performance of the centrifugal compressor 10.

Specifically, as described above, if the refrigerant with uneven flow enters the centrifugal compressor 10, sufficient performance of the centrifugal compressor 10 may not be obtained. However, in the compressor suction pipe 100 according to some embodiments shown in FIGS. 3A to 3H and 4A to 4D, the partition 150 and the inner partition 180 extend in a direction intersecting a virtual plane including the incircle C (see FIG. 3A) that touches the axis ax1 of the first pipe segment 110 on the upstream side of the downstream end 112 of the first pipe segment 110 and touches the axis ax2 of the second pipe segment 120. Accordingly, the partition 150 and the inner partition 180 divide the bent portion 101 forming the flow passage for the refrigerant into the first flow passage 161, 171 on the inner side with respect to the radial direction of the incircle C and the second flow passage 162, 172 on the outer side of the first flow passage 161, 171 with respect to the radial direction of the incircle C. Accordingly, at least from an intermediate portion of the first pipe segment 110 on the most upstream side at least to an intermediate portion of the second pipe segment on the most downstream side, the partition 150 and the inner partition 180 are positioned on the outer side of the bend in the first flow passage 161, 171 which is positioned on the inner side with respect to the radial direction of the incircle C. Thus, the partition 150 and the inner partition 180 guide the refrigerant so as to change the flow direction thereof from upward to rightward in the figure.

Consequently, it is possible to suppress uneven flow of the refrigerant in the vicinity of the downstream end 107 of the compressor suction pipe 100, and thus it is possible to suppress uneven flow of the refrigerant flowing into the centrifugal compressor 10 and prevent a reduction in performance of the centrifugal compressor 10.

In some embodiments, as shown in FIGS. 3A to 3H and 4A to 4D, the partition 150 and the inner partition 180 are disposed closer to the center O of the incircle C (see FIG. 3A) than the axis of the bent portion 101, i.e., the axis ax1 of the first pipe segment 110, the axis ax2 of the second pipe segment 120, and the axis ax3 of the third pipe segment 130.

Accordingly, with the compressor suction pipe 100 according to some embodiments, it is possible to suppress uneven flow of the refrigerant flowing through the compressor suction pipe 100 into the centrifugal compressor 10, and it is possible to prevent a reduction in performance of the centrifugal compressor 10.

That is, as described above, when the flow direction of a fluid flowing through a bent pipe is changed, the flow of the fluid varies between the inner side and the outer side of the bend due to inertia of the fluid. The variation of flow increases as the flow direction changes steeply, i.e., as the curvature radius of the bent pipe (flow passage) decreases. Further, the variation of flow between the inner side and the outer side of the bend increases as the width of the flow passage connecting the inner side and the outer side of the bend increases.

In compressor suction pipe 100 according to some embodiments shown in FIGS. 3A to 3H and 4A to 4D, since the partition 150 and the inner partition 180 are disposed closer to the center O of the incircle C than the axis of the bent portion 101 is to the center O, the width of the first flow passage 161 shown in FIGS. 3A to 3H is narrower than the width of the second flow passage 162 on the outer side in the radial direction of the incircle C. Similarly, the width of the first flow passage 171 shown in FIGS. 4A to 4D is narrower than the width from the inner side of the second flow passage 172 to the outer side of the third flow passage 173.

That is, in the compressor suction pipe 100 according to some embodiments shown in FIGS. 3A to 3H and 4A to 4D, with respect to the first flow passage 161, 171 in which the flow direction is changed more steeply than the second flow passage 162, 172 and the third flow passage 173, since the width of the first flow passage 161, 171, i.e., the distance between the partition 150 and the inner wall surface of the first flow passage 161 and the distance between the inner partition 180 and the inner wall surface of the first flow passage 171, is narrow, it is possible to suppress uneven flow in the first flow passage 161, 171, and it is possible to prevent a reduction in performance of the centrifugal compressor 10.

In some embodiments, as shown in FIGS. 3C to 3H and 4A to 4D, the interior of the bent portion 101 forms the first flow passage 161, 171 divided by the partition 150 and the inner partition 180 and closest to the center O of the incircle C (see FIG. 3A). The flow passage cross-sectional area at the downstream end of the first flow passage 161, 171 is smaller than the flow passage cross-sectional area at the upstream end of the first flow passage 161, 171.

Accordingly, with the compressor suction pipe 100 according to some embodiments, it is possible to control a reduction in flow velocity of the refrigerant at the outlet of the first flow passage 161, 171 and suppress uneven flow of the refrigerant flowing into the centrifugal compressor 10. Thus, it is possible to prevent a reduction in performance of the centrifugal compressor 10.

That is, since the first flow passage 161, 171 is the closest to the center O of the incircle C and thus the flow direction thereof changes more steeply than the other flow passages, less refrigerant flows into the first flow passage 161, 171 than the other flow passages, so that the flow velocity of the refrigerant tends to decrease in the first flow passage 161, 171.

However, according to the embodiments shown in FIGS. 3C to 3H and 4A to 4D, the flow passage cross-sectional area at the downstream end of the first flow passage 161, 171 is smaller than the flow passage cross-sectional area at the upstream end. By decreasing the flow passage cross-sectional area on the downstream side of the first flow passage 161, 171, the flow velocity on the downstream side of the first flow passage 161, 171 is increased. Thus, it is possible to control a reduction in flow velocity of the refrigerant at the outlet of the first flow passage 161, 171 and suppress uneven flow of the refrigerant flowing into the centrifugal compressor 10. Consequently, it is possible to prevent a reduction in performance of the centrifugal compressor 10.

In some embodiments, as shown in FIGS. 4A to 4D, the inner partition 180 and the outer partition 190 disposed opposite to the center O of the incircle C (see FIG. 3A) across the axis of the bent portion 101 are disposed in the bent portion 101.

Thereby, the flow passage on the outer side with respect to the radial direction of the incircle C divided by the inner partition 180 is further divided into a flow passage (second flow passage 172) on the inner side with respect to the radial direction of the incircle C and a flow passage (third flow passage 173) on the outer side with respect to the radial direction of the incircle C, and the width of each flow passage 171 to 173 of the bent portion 101 is decreased. Thus, it is possible to suppress uneven flow in each flow passage 171 to 173. Consequently, it is possible to prevent a reduction in performance of the centrifugal compressor 10.

In some embodiments, as shown in FIGS. 3B, 3D, and 4B, the first partition 151, 181, 191 extends to the upstream end 111 of the first pipe segment 110.

Thereby, the partition 150, the inner partition 180, and the outer partition 190 efficiently guide the refrigerant so as to change the flow direction of the refrigerant from upward to rightward in the figure. Accordingly, it is possible to suppress uneven flow of the refrigerant flowing into the centrifugal compressor 10, and it is possible to prevent a reduction in performance of the centrifugal compressor 10.

In some embodiments, as shown in FIGS. 3B, 3D to 3H and 4B to 4D, the second partition 152, 182, 192 extends to the downstream end 122 of the second pipe segment 120.

Thereby, the partition 150, the inner partition 180, and the outer partition 190 efficiently guide the refrigerant so as to change the flow direction of the refrigerant from upward to rightward in the figure. Accordingly, it is possible to suppress uneven flow of the refrigerant flowing into the centrifugal compressor 10, and it is possible to prevent a reduction in performance of the centrifugal compressor 10.

In some embodiments, as shown in FIGS. 3E to 3H, 4C, and 4D, the first partition 151, 181 includes the protruding portion 151*c*, 181*c* protruding upstream with respect to the flow of the refrigerant from the upstream end 111 of the first pipe segment 110. Further, in some embodiments, as shown in FIG. 4D, the first partition 191 includes the protruding portion 191*c* protruding upstream with respect to the flow of the refrigerant from the upstream end 111 of the first pipe segment 110.

Thereby, the protruding portion 151*c*, 181*c*, 191*c* guides the flow of the refrigerant on the upstream side of the upstream end 111 of the first pipe segment 110, and uneven flow on the upstream side of the first pipe segment 110 is suppressed. Thus, it is possible to suppress uneven flow of the refrigerant in the compressor suction pipe 100. Accordingly, it is possible to suppress uneven flow of the refrigerant flowing into the centrifugal compressor 10, and it is possible to prevent a reduction in performance of the centrifugal compressor 10.

In some embodiments, as shown in FIGS. 3E to 3H, 4C, and 4D, the protruding portion 151*c*, 181*c* of the first partition 151, 181 protrudes into the evaporator 15 from the connection portion 16. Further, in some embodiments, as shown in FIG. 4D, the protruding portion 191*c* of the first partition 191 protrudes into the evaporator 15 from the connection portion 16.

Thereby, the protruding portion 151*c*, 181*c*, 191*c* guides the flow of the refrigerant in the evaporator 15, and contracted flow in the vicinity of the connection portion 16 and thus uneven flow is suppressed. Thus, it is possible to suppress uneven flow in the compressor suction pipe 100. Accordingly, it is possible to suppress uneven flow of the refrigerant flowing into the centrifugal compressor 10, and it is possible to prevent a reduction in performance of the centrifugal compressor 10.

In some embodiments, as shown in FIGS. 3F to 3H and 4D, the distal end portion 151*d*, 181*d* of the protruding portion 151*c*, 181*c* extends in a direction different from the extension direction of the axis ax1 of the first pipe segment 110, specifically, in a direction away from the axis ax1 of the first pipe segment 110.

Further, in some embodiments, as shown in FIG. 4D, the distal end portion 191*d* of the protruding portion 191*c* extends in a direction different from the extension direction of the axis ax1 of the first pipe segment 110, specifically, in a direction away from the axis ax1 of the first pipe segment 110.

Thereby, the protruding portion 151*c*, 181*c*, 191*c* guides the flow of the refrigerant on the upstream side of the upstream end 111 of the first pipe segment 110, and uneven flow on the upstream side of the first pipe segment 110 is suppressed. Thus, it is possible to suppress uneven flow of the refrigerant in the compressor suction pipe 100. Accordingly, it is possible to suppress uneven flow of the refrigerant flowing into the centrifugal compressor 10, and it is possible to prevent a reduction in performance of the centrifugal compressor 10.

In some embodiments, as shown in FIGS. 3F to 3H and 4D, the protruding portion 151*c*, 181*c*, 191*c* protrudes into the evaporator 15, and the distal end portion 151*d*, 181*d*, 191*d* extends toward the body portion 15*a* of the evaporator 15.

Thereby, the protruding portion 151*e*, 181*c*, 191*c* guides the flow of the refrigerant in the evaporator 15, especially, the flow of the refrigerant flowing toward the connection portion 16 along the inner surface of the body portion 15*a*. Thus, it is possible to suppress contracted flow in the vicinity of the connection portion 16 and suppress uneven flow, and it is possible to suppress uneven flow in the compressor suction pipe 100. Accordingly, it is possible to suppress uneven flow of the refrigerant flowing into the centrifugal compressor 10, and it is possible to prevent a reduction in performance of the centrifugal compressor 10.

In some embodiments, as shown in FIG. 4D, the distal end portion 181*d* of the first partition 181 of the inner partition 180 and the distal end portion 191*d* of the first partition 191 of the outer partition 190 extend so that their upstream ends 181*a*, 191*a* are spaced from each other.

Thus, since the refrigerant nearly below the upstream ends 181*a*, 191*a* in the figure easily flows to the second flow passage 172, it is possible to ensure the flow rate of the refrigerant in the compressor suction pipe 100, and it is possible to improve the performance of the centrifugal compressor 10.

In some embodiments, as shown in FIGS. 3A to 3H and 4A to 4D, the partition 150, the inner partition 180, and the outer partition 190 include the first partition 151, 181, 191, the second partition 152, 182, 192, and the third partition 153, 183, 193 which are shaped in flat plate in each of the first to third pipe segments 110, 120, 130.

Thus, it is possible to suppress uneven flow of the refrigerant in the compressor suction pipe 100 by the partition 150, the inner partition 180, and the outer partition 190 of simple shapes. Thus, it is possible to reduce the manufacturing cost of the compressor suction pipe 100.

That is, the compressor suction pipe 100 is a so-called miter bend, in which the first to third pipe segments 110, 120, 130 are connected by welding or the like. For instance, before the first to third pipe segments 110, 120, 130 are connected, the plate-like first to third partitions 151 to 153, 181 to 183, 191 to 193 can be easily fixed to the first to third pipe segments 110, 120, 130 by welding or the like. Further, by connecting the first to third pipe segments 110, 120, 130 mounted with the first to third partitions 151 to 153, 181 to 183, 191 to 193 with each other, it is possible to form the partition 150, the inner partition 180, and the outer partition 190 which continue in the order of the first partition 151, 181, 191, the third partition 153, 183, 193, and the second partition 152, 182, 192 along the flow direction of the refrigerant. Thus, it is possible to produce the compressor suction pipe 100 at low cost.

In some embodiments, as shown in FIGS. 3G and 3H, in the connection portion 16 of the evaporator 15, the opening area of the opening 16*a* on the evaporator 15 side is larger than that of the opening 16*b* on the compressor suction pipe 100 side.

Thus, since the refrigerant easily flows from the evaporator 15 to the compressor suction pipe 100, it is possible to suppress contracted flow in the vicinity of the connection portion 16, and it is possible to suppress uneven flow. Accordingly, it is possible to suppress uneven flow of the refrigerant in the compressor suction pipe 100 and suppress uneven flow of the refrigerant flowing into the centrifugal compressor 10. Thus, it is possible to prevent a reduction in performance of the centrifugal compressor 10.

In the case where the connection portion 16 of the evaporator 15 is formed in a funnel shape as in the embodiment shown in FIG. 3G, it is possible to reduce the manufacturing cost by using a commercially available reducer.

In some embodiments, as shown in FIG. 3H, the connection portion 16 of the evaporator 15 has a bell-mouth shape.

Thus, since the refrigerant more easily flows from the evaporator 15 to the compressor suction pipe 100, it is possible to further suppress contracted flow in the vicinity of the connection portion 16, and it is possible to suppress uneven flow. Accordingly, it is possible to further suppress uneven flow of the refrigerant in the compressor suction pipe 100 and suppress uneven flow of the refrigerant flowing into the centrifugal compressor 10. Thus, it is possible to prevent a reduction in performance of the centrifugal compressor 10.

In the turbo chiller 1 according to the embodiment described above, the evaporator 15 and the centrifugal compressor 10 are connected by the compressor suction pipe 100 according to any of the embodiments described above. With this configuration, it is possible to suppress uneven flow of the refrigerant flowing into the centrifugal compressor 10, and it is possible to prevent a reduction in performance of the centrifugal compressor 10. Thus, it is possible to improve the performance and efficiency of the turbo chiller 1.

The present invention is not limited to the embodiments described above, but includes modifications to the embodiments described above, and embodiments composed of combinations of those embodiments.

(1) In the compressor suction pipe 100 according to some embodiments described above, the direction of the upstream end 106 and the direction of the downstream end 107 differ from each other by approximately 90 degrees. That is, the bend angle of the compressor suction pipe 100 according to some embodiments described above is approximately 90 degrees. However, the bend angle of the compressor suction pipe 100 is not limited to 90 degrees as long as at least a direction in which the first pipe segment 110 on the most upstream side extends downstream differs from a direction in which the second pipe segment 120 on the most downstream side extends downstream.

(2) In the compressor suction pipe 100 according to some embodiments described above, the diameter of each pipe segment 110, 120, 130 is identical. However, the diameter of each pipe segment 110, 120, 130 may vary. That is, for instance, the diameter of each pipe segment 110, 120, 130 may increase or decrease downstream.

(3) In the compressor suction pipe 100 according to some embodiments described above, the number of the pipe segment is three, but the number of the pipe segment may be four or more.

(4) In the compressor suction pipe 100 according to some embodiments described above, each of the first to third partitions 151 to 153, 181 to 183, 191 to 193 of the partition 150, the inner partition 180, and the outer partition 190 extends in a direction perpendicular to a plane of FIGS. 3A to 3H and 4A to 4D. However, the first to third partitions 151 to 153, 181 to 183, 191 to 193 may extend in a direction different from the direction perpendicular to the plane of the figure within a range of the effects described above. More specifically, although the first to third partitions 151 to 153, 181 to 183, 191 to 193 intersect the plane including the incircle C shown in FIG. 3A at 90 degrees, the intersection angle may deviate from 90 degrees within a range of about +15 degrees, for instance.

(5) In the compressor suction pipe 100 according to some embodiments described above, the axis ax1 of the first pipe segment 110 and the axis ax2 of the second pipe segment 120 are on the same plane. However, within a range of the effects described above, the axis ax1 of the first pipe segment 110 and the axis ax2 of the second pipe segment 120 may be twisted with each other.

(6) In the compressor suction pipe 100 according to some embodiments described above, as shown in FIGS. 3A to 3H, the partition 150 is disposed in an inner portion of the flow passage inside the axis of the bent portion 101, i.e., the axis ax1 of the first pipe segment 110, the axis ax2 of the second pipe segment 120, and the axis ax3 of the third pipe segment 130. However, at least a part of the partition 150 may be disposed in an outer portion of the flow passage outside the axis of the bent portion 101, as long as uneven flow of the refrigerant flowing into the centrifugal compressor 10 is suppressed.

Similarly, in the compressor suction pipe 100 according to some embodiments described above, as shown in FIGS. 4A to 4D, the inner partition 180 is disposed in an inner portion of the flow passage inside the axis of the bent portion 101. However, at least a part of the inner partition 180 may be disposed in an outer portion of the flow passage outside the axis of the bent portion 101, as long as uneven flow of the refrigerant flowing into the centrifugal compressor 10 is suppressed.

Further, in the compressor suction pipe 100 according to some embodiments described above, as shown in FIGS. 4A to 4D, the outer partition 190 is disposed in an outer portion of the flow passage outside the axis of the bent portion 101. However, at least a part of the outer partition 190 may be disposed in an inner portion of the flow passage inside the axis of the bent portion 101, as long as uneven flow of the refrigerant flowing into the centrifugal compressor 10 is suppressed.

(7) In the compressor suction pipe 100 according to some embodiments described above, as shown in FIGS. 3C to 3H, the width of the first flow passage 161 decreases downstream in the third pipe segment 130. However, the width of the first flow passage 161 may decrease downstream in the first pipe segment 110, and the width of the first flow passage 161 may decrease downstream in the second pipe segment 120.

Further, in the compressor suction pipe 100 according to some embodiments described above, as shown in FIGS. 4A to 4D, the width of the first flow passage 171 decreases downstream in the third pipe segment 130. However, the width of the first flow passage 171 may decrease downstream in the first pipe segment 110, and the width of the first flow passage 171 may decrease downstream in the second pipe segment 120.

(8) In some embodiments described above, as shown in FIGS. 3A to 3H and 4A to 4D, the first to third partitions 151 to 153, 181 to 183, 191 to 193 have a flat plate shape. That is, in the compressor suction pipe 100 according to some embodiments described above, flat plate members are used as the first to third partitions 151 to 153, 181 to 183, 191 to 193. However a plate member having a curved surface or a bent portion may be used as the first to third partitions 151 to 153, 181 to 183, 191 to 193.

(9) In some embodiments described above, as shown in FIGS. 3A to 3H and 4A to 4D, the number of the partition in each pipe segment 110, 120, 130 of the bent portion 101 is one or two, but the number of the partition may be three or more.

(10) In some embodiments described above, the compressor suction pipe 100 is used to connect the evaporator 15 and the centrifugal compressor 10 in the turbo chiller 1. However, the compressor suction pipe 100 according to some embodiments described above may be used to connect a compressor with a connection target machine in an apparatus other than the turbo chiller 1. For instance, the compressor suction pipe 100 according to some embodiments described above may be used to connect a centrifugal supercharger with an air cleaner box which takes air from the atmosphere in an apparatus including an internal combustion engine, such as a vehicle.

REFERENCE SIGNS LIST

1 Turbo chiller
10 Centrifugal compressor
11 Condenser
12 First expansion valve (Pressure reducer)
13 Second expansion valve (Pressure reducer)
15 Evaporator
16 Connection portion
16*a*, 16*b* Opening
100 Compressor suction pipe
101 Bent portion
110 First pipe segment
120 Second pipe segment
130 Third pipe segment
150 Partition
151 First partition
151*a* Upstream end
151*c* Protruding portion
151*d* Distal end portion
152 Second partition
153 Third partition
161 First flow passage
162 Second flow passage
180 Inner partition
181 First partition
181*a* Upstream end
181*c* Protruding portion
181*d* Distal end portion
182 Second partition
183 Third partition
190 Outer partition
191 First partition
191*a* Upstream end
191*c* Protruding portion
191*d* Distal end portion
192 Second partition
193 Third partition
ax1, ax2, ax3 Axis
C Incircle
O Center

The invention claimed is:

1. A compressor suction pipe connected to a suction side of a compressor which sucks a fluid to be compressed, comprising:

a bent portion configured to change a flow direction of the fluid from a first direction to a second direction, the bent portion including at least a first pipe segment on the most upstream side with respect to flow of the fluid, a second pipe segment connected to the suction side of the compressor and extending in a direction different from an extension direction of the first pipe segment, and a third pipe segment disposed between the first pipe segment and the second pipe segment and extending in a direction different from the extension direction of the first pipe segment and from an extension direction of the second pipe segment; and at least one partition extending at least from an intermediate portion of the first pipe segment at least to an intermediate portion of the second pipe segment in the bent portion and dividing an interior of the bent portion, wherein the at least one partition extends in a direction intersecting a virtual plane including an incircle that touches an axis of the first pipe segment on an upstream side of a downstream end of the first pipe segment and touches an axis of the second pipe segment, and wherein the at least one partition has a flat plate shape in each of the first pipe segment, the second pipe segment, and the third pipe segment.

2. The compressor suction pipe according to claim 1, wherein the at least one partition includes an inner partition disposed closer to a center of the incircle than an axis of the bent portion is to the center.

3. A chiller comprising:

the compressor suction pipe according to claim 1;

the compressor for compressing a refrigerant;

a condenser for condensing the refrigerant compressed by the compressor;

an expansion valve for expanding the refrigerant condensed by the condenser; and an evaporator for evaporating the refrigerant expanded by the expansion valve, wherein the evaporator is connected to an upstream end of the first pipe segment of the compressor suction pipe.

4. The compressor suction pipe according to claim 2, wherein an inner flow passage divided by the inner partition and closest to the center of the incircle is formed in the bent portion; and wherein a flow passage cross-sectional area at a downstream end of the inner flow passage is smaller than a flow passage cross-sectional area at an upstream end of the inner flow passage.

5. The compressor suction pipe according to claim 2, wherein the at least one partition includes:

the inner partition; and an outer partition disposed opposite to the center of the incircle across the axis of the bent portion.

6. The compressor suction pipe according to claim 2, wherein the at least one partition extends to an upstream end of the first pipe segment.

7. The compressor suction pipe according to claim 2, wherein the at least one partition extends to a downstream end of the second pipe segment.

8. A compressor suction pipe connected to a suction side of a compressor which sucks a fluid to be compressed, comprising:

a bent portion configured to change a flow direction of the fluid from a first direction to a second direction, the bent portion including at least a first pipe segment on the most upstream side with respect to flow of the fluid, a second pipe segment connected to the suction side of the compressor and extending in a direction different from an extension direction of the first pipe segment, and a third pipe segment disposed between the first pipe segment and the second pipe segment and extending in a direction different from the extension direction of the first pipe segment and from an extension direction of the second pipe segment; and at least one partition extending at least from an intermediate portion of the first pipe segment at least to an intermediate portion of the second pipe segment in the bent portion and dividing an interior of the bent portion, wherein the at least one partition extends in a direction intersecting a virtual plane including an in circle that touches an axis of the first pipe segment on an upstream side of a downstream end of the first pipe segment and touches an axis of the second pipe segment, wherein the at least one partition includes an inner partition disposed closer to a center of the incircle than an axis of the bent portion is to the center, and wherein the at least one partition includes a protruding portion protruding upstream from an upstream end of the first pipe segment with respect to flow of the fluid.

9. The compressor suction pipe according to claim 8, wherein the protruding portion extends in a direction different from the first direction at least on an upstream side with respect to flow of the fluid.

10. The compressor suction pipe according to claim 8, wherein the at least one partition has a flat plate shape in each of the first pipe segment, the second pipe segment, and the third pipe segment.

11. A chiller comprising:

the compressor suction pipe according to claim 8;

the compressor for compressing a refrigerant;

a condenser for condensing the refrigerant compressed by the compressor;

an expansion valve for expanding the refrigerant condensed by the condenser; and an evaporator for evaporating the refrigerant expanded by the expansion valve, wherein the evaporator is connected to an upstream end of the first pipe segment of the compressor suction pipe.

12. A chiller comprising:

a compressor suction pipe connected to a suction side of a compressor which sucks a fluid to be compressed, comprising:

a bent portion configured to change a flow direction of the fluid from a first direction to a second direction, the bent portion including at least a first pipe segment on the most upstream side with respect to flow of the fluid, a second pipe segment connected to the suction side of the compressor and extending in a direction different from an extension direction of the first pipe segment, and a third pipe segment disposed between the first pipe segment and the second pipe segment and extending in a direction different from the extension direction of the first pipe segment and from an extension direction of the second pipe segment; and at least one partition extending at least from an intermediate portion of the first pipe segment at least to an intermediate portion of the second pipe segment in the bent portion and dividing an interior of the bent portion, wherein the at least one partition extends in a direction intersecting a virtual plane including an incircle that touches an axis of the first pipe segment on an upstream side of a downstream end of the first pipe segment and touches an axis of the second pipe segment, the compressor for compressing a refrigerant;

a condenser for condensing the refrigerant compressed by the compressor;

an expansion valve for expanding the refrigerant condensed by the condenser; and an evaporator for evaporating the refrigerant expanded by the expansion valve, wherein the evaporator is connected to an upstream end of the first pipe segment of the compressor suction pipe, and wherein the evaporator has a connection portion connected to the compressor suction pipe, and an opening area of the connection portion on a side of the evaporator is larger than an opening area of the connection portion on a side of the compressor suction pipe.

13. The chiller according to claim 12, wherein the connection portion has a bell-mouth shape.

* * * * *